US007078643B2

(12) United States Patent
Rostron et al.

(10) Patent No.: US 7,078,643 B2
(45) Date of Patent: Jul. 18, 2006

(54) CAPACITOR SWITCH WITH INTERNAL RETRACTING IMPEDANCE CONTACTOR

(76) Inventors: Joseph R. Rostron, 148 Darwish Dr., McDonough, GA (US) 30252; Neil McCord, 525 Stonehave Dr., Fayetteville, GA (US) 30215

( * ) Notice: Subject to any disclaimer, the term of this patent is extended or adjusted under 35 U.S.C. 154(b) by 309 days.

(21) Appl. No.: 10/736,402

(22) Filed: Dec. 15, 2003

(65) Prior Publication Data

US 2005/0128662 A1 Jun. 16, 2005

(51) Int. Cl.
*H01H 9/42* (2006.01)
*H01H 33/16* (2006.01)

(52) U.S. Cl. ..... 218/144

(58) Field of Classification Search ..... 218/144
See application file for complete search history.

(56) References Cited

U.S. PATENT DOCUMENTS

| | | | | |
|---|---|---|---|---|
| 2,775,670 | A * | 12/1956 | Geiger, Jr. | 218/58 |
| 3,538,276 | A | 11/1970 | Leeds | |
| 3,863,041 | A | 1/1975 | Rostron et al. | |
| 4,338,500 | A | 7/1982 | Pham et al. | |
| 4,421,962 | A * | 12/1983 | Thuries et al. | 218/143 |
| 4,788,390 | A | 11/1988 | Crino | |
| 5,245,145 | A | 9/1993 | Freeman et al. | |
| 5,276,285 | A | 1/1994 | Pham et al. | |
| 5,451,731 | A | 9/1995 | Yoshizumi et al. | |
| 5,567,924 | A | 10/1996 | Yano et al. | |
| 5,734,140 | A * | 3/1998 | Hokuto et al. | 218/143 |
| 5,742,017 | A | 4/1998 | Perret | |
| 5,814,782 | A | 9/1998 | Muller et al. | |
| 5,841,614 | A | 11/1998 | Perret | |
| 6,236,010 | B1 | 5/2001 | Rostron | |
| 6,239,399 | B1 | 5/2001 | Perret | |
| 6,538,347 | B1 * | 3/2003 | Baranowski et al. | 307/137 |
| 6,583,978 | B1 | 6/2003 | Rostron et al. | |
| 6,597,549 | B1 | 7/2003 | Anand et al. | |

* cited by examiner

*Primary Examiner*—Phuong T. Vu
*Assistant Examiner*—Scott Bauer
(74) *Attorney, Agent, or Firm*—Michael J. Mehrman; Mehrman Law Office, P.C.

(57) ABSTRACT

A capacitor switch including a power contactor and an impedance contactor located within a relatively slender container filled with dielectric gas. The container may be a "dead tank" or an insulator. For the insulator configuration, the switch also includes a conductive cap housing a charging impedance located on the end of the insulator. The power contactor includes a relatively fixed probe contact and a linearly moving socket. The impedance contactor is ring-type butt contactor surrounding the penetrating contactor that includes a retracting (but otherwise fixed) contact that surrounds the fixed probe, and a traveling ring contact that surrounds and moves with the moving socket contact. The impedance contactor closes before the power contactor on the closing stroke to introduce the charging impedance into the circuit. A puffer mechanism retards the expansion of the retracting contact on the opening stroke, which causes the impedance contactor to open before the power contactor.

33 Claims, 18 Drawing Sheets

CAPACITOR SWITCH WITH INTERNAL RETRACTING IMPEDANCE CONTACTOR

TECHNICAL FIELD

The present invention relates to electric switchgear and, more particularly, relates to an electric power switch, which is suitable for use as a capacitor switch at distribution and sub-transmission voltages, with a linear moving penetrating contactor and a retracting impedance contactor located inside a container filled with dielectric gas.

BACKGROUND OF THE INVENTION

Circuit breakers, line switches, disconnect switches and capacitor switches are well known components of electric transmission and distribution systems. Within these devices, spring-driven acceleration mechanisms have been used to accelerate penetrating contactors to sufficient velocity to extinguish an arcing contact occurring across a contactor gap within the switch without experiencing an undesirable restrike, which could otherwise cause disturbances on the electric power system. This typically requires extinguishing the arc after one-half cycle, which prevents a restrike from occurring after the initial arc break that occurs at the first half-cycle zero voltage crossing after initial separation of the contacts. For this type of device, it is helpful to house the penetrating contactor within a sealed container filled with a dielectric gas such as sulphur hexafluoride ($SF_6$), which is directed into the contactor gap by a nozzle to help extinguish the arc. Extinguishing the arc in this manner, which is specifically designed to effectively absorb the arc energy, reduces the contactor gap separation required to extinguish the arc from what would be required to extinguish the arc in another environment such as air.

The basic design challenge for this type of device involves engineering an acceleration mechanism that obtains the desired contractor velocity quickly enough to extinguish the arc without experiencing an undesired restrike. An example of this type of device is shown in Rostron et al., U.S. Pat. No. 6,583,978 entitled "Limited Restrike Electric Power Circuit Interrupter Suitable For Use as a Line Capacitor and Load Switch," which is incorporated herein by reference. In addition, other types of spring-driven acceleration mechanism have been used to accelerate penetrating contactors for many years. In general, spring-driven acceleration and toggle mechanisms for accelerating penetrating contactors for single- and three-phase electric power switch configurations are well known.

Using this type of device as a capacitor switch imposes an added objective of breaking the arc occurring across the contactor gap without experiencing an undesirable switching surge caused by the inrush current into the initially discharged capacitor. As is well known in the electric utility industry, the inrush current into the initially discharged capacitor spikes when the switch closes because the capacitor initially behaves like a theoretical short circuit. In typical electric power applications, this transient inrush current can spike to three or more times the rated current of the electric power circuit. The resulting current transient also causes a transient surge in the voltage of the electric power system. For example, voltage surges in the power system of 1.7 per-unit (i.e., 1.7 times the operating voltage) have been caused by capacitor switching in typical electric power applications.

One option for constructing a capacitor switch that reduces these types of system disturbances is to introduce a charging impedance into the circuit just prior to closing the power contactor that introduces the capacitor into the power circuit. The charging impedance typically includes a resistor, an inductor, or a combination of a resistor and an inductor. This approach initially charges the capacitor through the charging impedance, which prevents the inrush current from spiking when the initially discharged capacitor is first introduced into the circuit. Reducing the capacitor inrush current with a properly sized charging impedance allows reduces the voltage surge and associated voltage disturbance occurring on the electric power system. For this type of capacitor switch, the impedance contactor, as well as the charging impedance itself (or impedances), can be located inside or outside the container that houses the main power contactors.

For example, Leeds, U.S. Pat. No. 3,538,276, which is incorporated herein by reference, shows a circuit breaker with impedances located on the interior of the container filled with dielectric gas. These impedances are entered into the circuit prior to the closing of the main power contacts on switch's closing stroke. However, this device requires a large container to house the charging impedances. In addition, the switching device described in this patent includes a rotary contactor acceleration device that is cumbersome and requires a much larger container than a linear moving contactor arrangement. Therefore, this design is appropriate for a high voltage circuit breaker, but it is an expensive and relatively unreliable alternative for use as a capacitor switch that is intended to operate daily or several times a day.

Capacitor switches with external charging impedances and external impedance contactors have also been developed. These devices have been designed to close the impedance contactor before the main power contactor on the closing stroke, and to open the impedance contactor prior to the main power contactor on the opening stroke, as is desirable for a capacitor switch. However, these devices have conventionally relied an external charging impedance (or impedances) introduced into the circuit through an external whip. See, for example, Anand et al., U.S. Pat. No. 6,597,549 entitled "Capacitor Switch With External Impedance and Insertion Whip," which is incorporated herein by reference. Although this device avoids the large container of the Leeds circuit breaker and implements the contactor closing sequence on the opening and closing strokes desired for a capacitor switch, the external whip is exposed to the weather elements. As a result, the whip can become frozen in place during freezing rain or sleet condition, which can disable the whip portion of the device and thereby decrease its reliability. For this reason, the external whip design alternative is most suitable to climates that do not experience a significant amount of frozen precipitation. In addition, the external moving components of the whip configuration increase the cost and complexity of the device, and can impose a significant additional maintenance requirement for the capacitor switch, which is intended to operate daily or several times a day for most application.

Accordingly, there is an ongoing need for a cost effective electric power switch suitable for use as a capacitor switch. There is a further need for a capacitor switch that includes a charging impedance that does not rely on an unduly large container filled with dielectric gas or an external insertion whip.

SUMMARY OF THE INVENTION

The present invention meets the needs described above in an electric power switch including a main power contactor and an impedance contactor located on the interior of a container filled with dielectric gas. The impedance contactor introduces a charging impedance into the electric circuit on the closing stroke to reduce the inrush current into an initially discharged capacitor. The switch also includes a timing device that causes the impedance contactor to close before the power contactor on the closing stroke, and to open before the power contactor on the opening stroke. This contactor operation sequence makes the switch is suitable for use as a capacitor switch at distribution and sub-transmission voltages.

The configuration of the capacitor switch gives it a number of advantages over conventional capacitor switches, which are generally more expensive, more complex, and less reliable than the present design. In particular, the present capacitor switch typically includes a ring shaped impedance contactor positioned around a probe-and-socket type penetrating main power contactor, which allows both contactors to operate in a linearly travel path. This allows both contactors to be housed within a relatively slender insulator forming the container filled with dielectric gas, which is smaller and less expensive than the containers of conventional circuit breakers and capacitor switches. In addition, the charging impedance is preferably located within a conductive cap on the outside and at the end of the insulator, which allows the charging impedance to be easily removed and replaced without opening the insulator or otherwise disassembling the switch. This design feature also removes the charging impedance from the temperature sensitive insulator and its temperature sensitive internal components, such as seals and the dielectric gas in the area of the main power contactor. Moreover, physically separating the insulator from the conductive cap, which is energized along with the impedance as part of the capacitor terminal, allows the insulator to be replaced by an electrically grounded conductive container for use in a "dead tank" configuration.

In addition, the timing device of the present capacitor switch is typically configured as a puffer mechanism within a retracting, but otherwise fixed, contact of the impedance contactor. This avoids locating the timing mechanism on the moving contact of the impedance contactor, which would increase the weight of the moving portion of the switch that has to be accelerated to a sufficient separation speed on the opening stroke to avoid a restrike. This design technique, in turn, is reflected in a smaller and less expensive accelerator mechanism for the switch. In addition, the charging impedance is electrically connected to the contactor with properly insulated internal posts, which avoids external components and linkages that would add cost and complexity to the switch.

Generally described, the invention may be realized in an electric power switch that includes an impedance and a power contactor that closes an electric power circuit on a closing stroke and opens the circuit on an opening stroke. This power contactor typically includes a linearly moving contactor, such as a penetrating contactor, having a fixed contact and a moving contact. The switch also includes an impedance contactor that enters the impedance into the circuit on the closing stroke and removes the impedance from the circuit on the opening stroke. This impedance contactor typically includes a linear moving butt contactor having a retracting contact positioned adjacent to the fixed contact of the power contactor, and includes a traveling contact that moves with the moving contact of the power contactor. To implement the desired contactor operation sequence, the switch also includes a timing device that causes the impedance contactor to close before the power contactor on the closing stroke, and causes the impedance contactor to open before the power contactor on the opening stroke. In addition, both the power contactor and the impedance contactor may be housed within a container filled with dielectric gas.

For example, this container may include a grounded conductive tank in what is generally referred to as a "dead tank" configuration. Alternatively, the container may include an insulator extending between first and second ends a sufficient distance to prevent arcing from occurring between a first electric power terminal located at the first end and a second electric power terminal located at the second end when a rated voltage for the switch is applied across the power terminals. In addition, the impedance may be housed within a conductive cap forming a part of the first electric power terminal located at the first end of the insulator. To avoid the use of linkages and external components, the charging impedance may be electrically connected to the contactors within the insulator with internal posts. With this configuration, the present switch may be used to introduce a capacitor into the electric power circuit during the closing stroke, and to disconnect the capacitor from the electric power circuit during the opening stroke. To avoid system disturbances when switching the capacitor out of the circuit, the switch may also include an accelerator driving the power contactor and the impedance contactor at sufficient speed to avoid a restrike during the opening stroke.

Typically, the impedance contactor includes a retracting contact that moves between an extended position and a retracted position. For this configuration, the timing device may include a puffer mechanism that resists movement of the retracting contact between the retracted position and the extended position through pneumatic compression in order to cause the impedance contactor to open before the power contactor on the opening stroke. This puffer mechanism may include a chamber integral with the retracting contact and a restrictive orifice venting the chamber. The switch may also include a flow control device affecting the size of the restrictive orifice and thereby adjusting the timing of the movement of the retracting contactor during the opening stroke.

The power contactor typically includes a linearly moving penetrating contactor having a probe-shaped fixed contact and a socket-shaped moving contact. In addition, the impedance contactor typically includes a linear moving butt contactor having a retracting contact positioned adjacent to the fixed contact of the power contactor, and includes a traveling contact that moves with the moving contact of the power contactor. More specifically, the retracting contact of the impedance contactor may include a conductive ring positioned around the fixed contact of the power contactor, and the traveling contact of the impedance contactor may include a conductive ring positioned around the moving contact of the power contactor.

For this particular configuration, the timing device typically controls the movement of the retracting contact during the opening stroke, for example through a puffer mechanism that retards the movement of the retracting during the opening stroke. The switch also typically includes a nozzle configured to direct a stream of the dielectric gas into a contactor gap occurring across the power contactor during the closing and opening strokes. The switch may also include an accelerator that drives the power contactor and the impedance contactor at sufficient speed to avoid a restrike during the opening stroke when a connected device, such as a capacitor, is removed from the electric circuit.

Stated somewhat differently, the switch may include an impedance and a power contactor including a fixed contact and a moving contact operable for closing an electric power circuit on a closing stroke and opening the circuit on an opening stroke. The switch may also include an impedance contactor including a retracting contact positioned adjacent to the fixed contact, and includes a traveling contact that moves with the moving contact. This retracting contact is typically movable between an extended position and a retracted position, and it is also configured to retract from the extended position to the retracted position under force applied by the traveling contact during the closing stroke. The switch may also include a container filled with dielectric gas housing the power contactor and a nozzle configured to direct a stream of the dielectric gas into a contactor gap occurring across the fixed contact and the moving contact of the power contactor during the closing and opening strokes. The switch may also include an accelerator driving the power contactor and the impedance contactor at sufficient speed to avoid a restrike during the opening stroke. In addition, the switch may include a timing device operable for controlling the movement of the retracting contact to cause the impedance contactor to close before the power contactor on the closing stroke, and to cause the impedance contactor to open before the power contactor on the opening stroke.

In a particular configuration, the power contactor may include a penetrating contactor and the impedance contactor may include a butt contactor. The impedance contactor, like the power contactor, is typically located inside the dielectric gas container. The switch may also include a capacitor (e.g., a bank of discrete capacitors) introduced into the electric power circuit during the closing stroke and disconnected from the electric power circuit during the opening stroke. Moreover, the container may include an insulator extending between first and second ends a sufficient distance to prevent arcing from occurring between a first electric power terminal located at the first end and a second electric power terminal located at the second end when a rated voltage for the switch is applied across the power terminals. For this configuration, the impedance may be housed within a conductive cap that forms a part of the first electric power terminal located at the first end of the insulator.

In addition, the traveling contact of the impedance contactor may include a conductive ring positioned around the moving contact of the power contactor, and the retracting contact of the impedance contactor may include a conductive ring positioned around the fixed contact of the power contactor. The switch may also include a spring to bias the retracting contact toward the extended position. And as noted previously, the puffer mechanism may include a chamber integral with the retracting contact and a restrictive orifice venting the chamber, and the switch may include a flow control device affecting the size of the restrictive orifice and thereby adjusting the timing of the movement of the retracting contactor.

In view of the foregoing, it will be appreciated that the present invention provides a cost effective electric power switch suitable for use as a capacitor switch. In particular, the invention provides a capacitor switch utilizing a charging impedance, which includes a power contactor and an impedance contactor located on the inside of a container filled with dielectric gas. In addition, the operation of the switch is controlled such that the impedance contactor closes before the power contactor on the closing stroke, and such that the impedance contactor opens before the power contactor on the opening stroke. The specific techniques and structures for implementing a particular embodiment of this capacitor switch, and thereby accomplishing the advantages described above, will become apparent from the following detailed description of the embodiments and the appended drawings and claims.

DETAILED DESCRIPTION OF THE EMBODIMENTS

Figure 2:
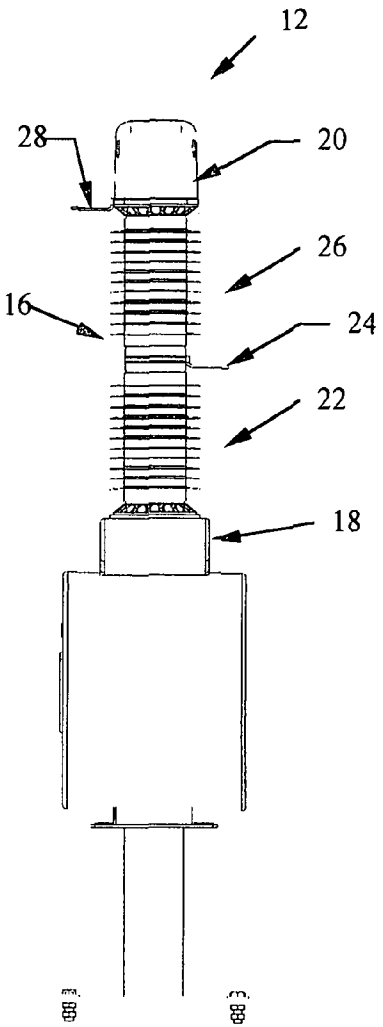
FIG. 2 is side view of a capacitor switch.

The present invention may be embodied in an electric power switch that is suitable for use as a capacitor switch at distribution and sub-transmission voltages. The capacitor switch typically includes a power contactor and an impedance contactor located within a relatively slender insulator forming a container filled with dielectric gas. The capacitor switch also includes a conductive cap housing a charging impedance located on the end of the insulator, which physically separates the conductive cap and the charging impedance from the insulator. This allows the conductive cap to be electrically separated from container, which allows the insulator to be replaced by a grounded conductive container in a "dead tank" configuration.

The power contactor may be a probe-and-socket type penetrating contactor, with a fixed probe and a moving socket. Similarly, the impedance contactor may be a ring-type butt contactor surrounding the penetrating contactor. The butt contactor typically includes a retracting (but otherwise fixed) contact that surrounds the fixed probe, and a traveling ring contact that surrounds and moves with the moving socket contact. In this configuration, the traveling contact pushes the retracting contact from an extended position to a retracted position during the closing stroke of the switch. As noted previously, the impedance contactor closes before the power contactor on the closing stroke to introduce the charging impedance into the circuit on the closing stroke. In addition, a timing device retards the expansion of the retracting contact on the opening stroke, which causes the impedance contactor to open before the power contactor on the opening stroke.

For example, the timing device may include a puffer mechanism with a pneumatic chamber and a restrictive orifice that retards the expansion of the retracting contact through pneumatic compression during the opening stroke. However, other types of timing mechanism may be employed, such as a weight that provides the retracting contact with sufficient inertia to implement the desired operating sequence of the contactors. Other types of timing devices may also be employed, such as a ratchet and pawl device, an eccentric cam device, a retracting detent mechanism, a spring-loaded detent mechanism, a magnetic detent mechanism, a frictional detent mechanism, and so forth.

In addition, it should be understood that the specific contactor configuration of the present capacitor switch may be varied. For example, the main power contactor may be a retracting butt contactor, and/or the impedance contactor may be penetrating contactor. Similarly, the impedance contactor need not extend all the way around the power contactor, but may instead be segmented or configured as one or more discrete contactors, such as conventional cylindrical butt contactors. In addition, the impedance contactor could conceivably be physically separated from the power contactor and located elsewhere within the insulator or even outside the container filled with dielectric gas. For example, either the main power contactor or the impedance contactor could be located in the lower section of the insulator. The switch could also include a separate accelerator for moving the power and impedance contacts. Many other design alternatives will become apparent to those skilled in the electric power industry. However, these design alternatives would generally increase the cost and/or complexity of the switch. As a result, the specific configuration shown in the attached figures, which are described below, is presently considered to be the best design alternative for the present capacitor switch.

Further, the capacitor switch described above may be provided by itself or with a capacitor or, more likely for an electric power application, a bank of capacitors. For this reason, the term "capacitor" as used in this specification included a single discrete capacitor, a bank of discrete capacitors, and any other suitable construct that includes one or more capacitors along with other circuit components. It should also be understood that the invention may be implemented as a stand-alone capacitor switch, or as a capacitor or capacitor bank with an associated capacitor switch. In addition, the charging impedance may include a resistor, an inductor, or a combination of one or more resistors and inductors connected in any desired configuration. The invention may also be deployed in single-phase, two-phase, and three-phase configurations connected in a Delta or Wye manner. It should also be appreciated that the invention is well suited for use as a capacitor switch, but may be used for other types of electric power switching applications.

Figure 1:
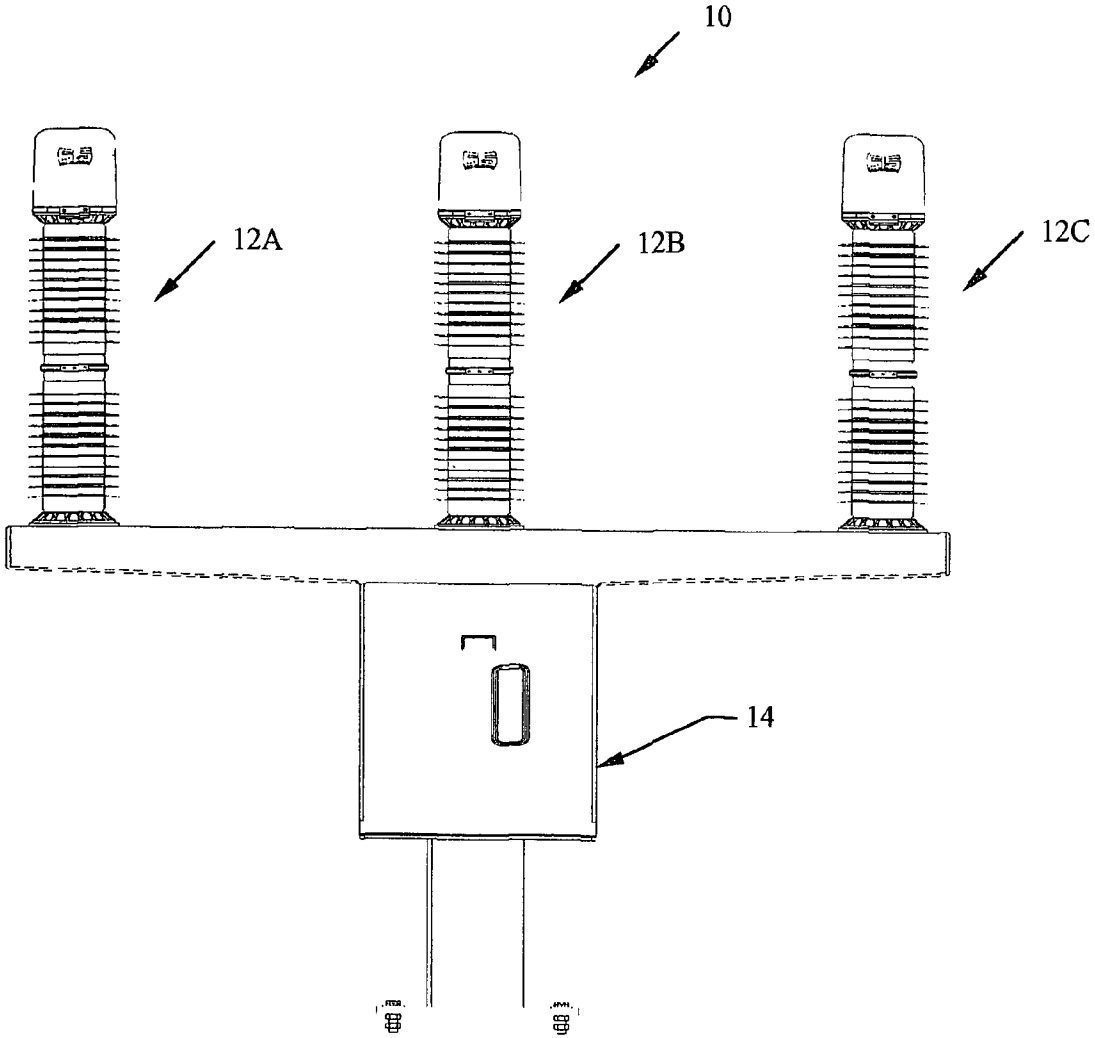
FIG. 1 is a front view showing the exterior appearance of a three-phase electric power switch including three capacitor switches, one for each phase, and an accelerator for driving the switches.

Turning now to the figures, in which like numerals refer to similar elements throughout the several figures, FIG. 1 is a front view showing the exterior appearance of a three-phase capacitor switch 10 including three capacitor switches 12A–C and an accelerator 14 for driving the switches. Each capacitor switch 12A–C is substantially identical and dedicated to a specific phase of a three-phase electric power system. The accelerator 14 is a typically a motor-driven spring-operated toggle mechanism that drives all three capacitor switch 12A–C using a common motor drive. Any suitable type of drive accelerator system may be used, and those skilled in the electric power industry will understand that these types of are well known and have been used in circuit breakers, line switches, capacitor switches, disconnect switches and other types of electric power switches for many years. An illustrative acceleration mechanism is described in Rostron et al., U.S. Pat. No. 6,583,978 entitled "Limited Restrike Electric Power Circuit Interrupter Suitable For Use as a Line Capacitor and Load Switch," which is incorporated herein by reference. However, other types of accelerator mechanisms may be used with the capacitor switches 12A–C.

Figure 3:
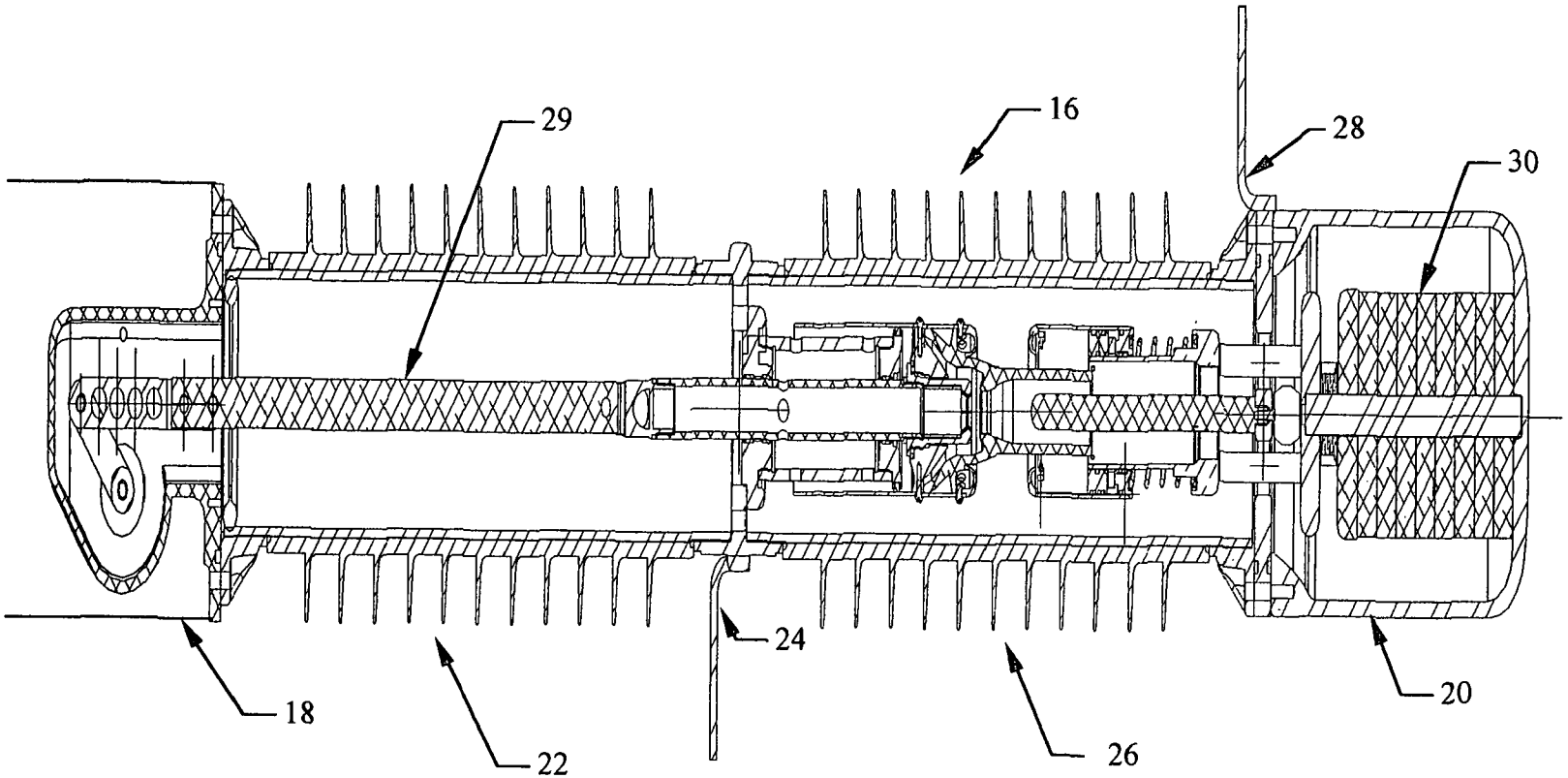
FIG. 3 is side crosssection side view of the capacitor switch of FIG. 2.

FIG. 2 is side view of the exterior of a single capacitor switch, and FIG. 3 shows a side crosssection view of the capacitor switch, which will be designated as capacitor switch 12 for convenience. The switch 12 includes a slender insulator 16 extending between a grounded support frame 18 and a conductive cap 20 that houses a charging impedance. The support frame 18 houses a linkage connecting the accelerator 14 to the internal components of the switch 12, which are housed within the insulator 16, which forms a container filled with a dielectric gas (typically $SF_6$). These internal components, which are located in the insulator 16, include a main power contactor and an impedance contactor, as described in greater detail below. The insulator 16 includes a lower insulator section 22 that extends from the grounded support frame 18 to a line terminal 24 that is connected to an associated phase line of the electric power system. Of course, the distance between the support frame 18 to a line terminal 24 is sufficient to prevent the voltage from flashing over the lower insulator section 22 when the rated line voltage is connected across the lower insulator section 22.

The insulator 16 also includes an upper insulator section 26 that extends from the line terminal 24 to a capacitor terminal 28, which is electrically connected to the conductive end cap 20. Again, the distance between the line terminal 24 and the capacitor terminal 28 is sufficient to prevent the voltage from flashing over the upper insulator section 26 when the rated line voltage is connected across the upper insulator section 26. The upper insulator section 26 houses the main power connector and the impedance contactor, as described in greater detail below. As shown in FIG. 3, the lower insulator section 22 is empty except for a linkage rod 29 connecting the contactors in the upper insulator section 26 to a horizontal linkage rod connected to the accelerator 14. With this configuration, the capacitor switch 12 is configured to connect a capacitor, which is connected to the capacitor terminal 28, to the line terminal 24 when the main power contactor is closed, and to disconnect the capacitor from the line terminal 24 when the main power contactor is closed.

As described in detail below, the capacitor switch 12 also closes the impedance contactor just prior to the main power contactor on the closing stroke to introduce the charging impedance housed within the conductive end cap 20 into the circuit prior to closing the main power contact. This suppresses the initial current surge by charging the discharged capacitor, which initially behaves like a theoretical short circuit, through the charging resistor. Suppressing the initial current surge also reduces the voltage disturbance on the electric power system, which is one of the ultimate design objectives of the capacitor switch 12. At this point, it should be noted that the location of the charging impedance with in the end cap 20 on the end of the insulator 16 results in a number of advantages. In particular, the impedance can be easily removed and replaced by removing the end cap 20 without opening the insulator 16 or otherwise disassembling the contactor mechanism within the insulator. In addition, the charging impedance is physically removed from the thermally sensitive insulator 16 and its thermally sensitive components, such as seals and the dielectric gas in the area of the main power contactor.

Figure 4:
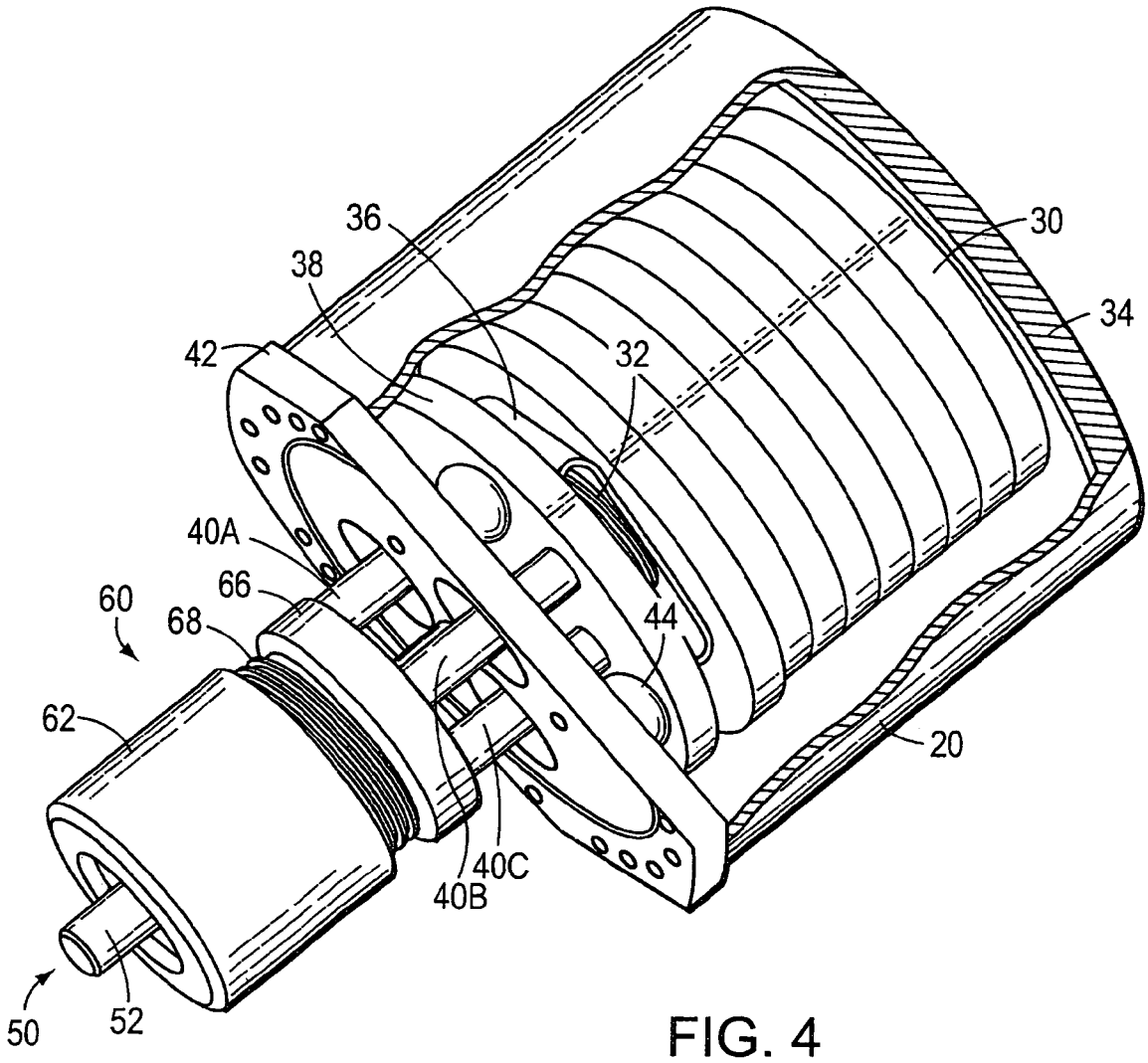
FIG. 4 is a partially cut away perspective side view of the impedance and retracting contact of the capacitor switch.

FIG. 4 is a partially cut away perspective side of the end cap 20 showing the impedance 30 located within the end cap. The impedance 30 is typically a resistor or an inductor, and both types of impedances have been shown to operate effectively as a charging impedance. In either case, the impedance 30 is a high-current, short-duration device configured to receive and partially dissipate the large inrush current flowing into the initially discharged capacitor. This large inrush current thermally expands the impedance 30, which is therefore maintained under compression. Specifically, the impedance 30 is typically formed from a number of discrete disks around a central shaft. A spring device 32, such as a Belleville washer, other suitable spring washer or coil spring, compresses the impedance 30 against the upper end plate 34 of the cap 20 to ensure a solid electrical contact in maintained between the impedance and the upper end plate of the cap. A shunt 36 carries the current from a current-carrying base plate 38 around the spring device 32 to prevent deterioration of the spring device from repetitive current surges.

The base plate 38, in turn, is supported by posts 40A–C, which extend through a bottom end plate 42 of the end cap 20. The base plate 38 is separated from the bottom end plate 42 of the end cap 20 by several insulators 44 (only one insulator is labeled to avoid cluttering the figure). These insulators, which are typically made of fiberglass or another durable material, provide back pressure for the spring device 32, and also ensure that proper clearance is maintained between the base plate 38 and the bottom end plate 42 of the end cap 20 to prevent a flash over between these components due to the voltage drop across the impedance 30. For the same reason, proper spacing must be maintained between the base plate 38 and the posts 40A–C, which pass through appropriately sized holes in the base plate. These holes may be filled with an insulator, and in particular it has been determined that allowing these holes to be filled with the dielectric gas (e.g., $SF_6$) within the insulator 16 helps to prevent flash over at these locations. This is an important improvement over prior capacitor switches because it allows the electric connection between the contactors inside the insulator 16 and the impedance 30 within the end cap 20 to be internal to the switch without significantly increasing the diameter of the insulator, which avoids a larger insulator as well as complicated linkages and external components. As a result, the exterior view of the switch 12 has the uncomplicated, slender and elegant appearance evident in FIGS. 1 and 2.

FIG. 4 also shows part of the main power contactor 50, which is a penetrating contactor including a fixed, male probe-type contact 52 and a moving tulip-type socket contact 54 (not shown in this figure). This figure also shows part of the impedance contactor 60, which is a butt contactor including a ring-type retracting (otherwise fixed) contact 62 and a ring-type traveling contact 64 (not shown in this figure). The retracting contact 62 moves between an extended position, as shown in FIG. 3, and a retracted position, in which the retracting contact is flush against a rear cuff 66. A spring 68 extends between the rear cuff 66 and the retracting contact 62 to urge the retracting contactor toward the extended position. Of course, the spring 68 may be replaced by another suitable device for urging the retracting contact 62 toward the extended position, such as a pneumatic cylinder, a solenoid, and magnetic coupling, an inertial coupling (i.e., a weigh attached to the retracting contact), and so forth.

The positional relationship between the main power contactor 50 and the impedance contactor 60 is selected such that, curing the closing stroke of the switch, the impedance contactor closes just before the main power contactor to introduce the impedance 30 into the circuit at the desired time and for a desired duration, typically in the range of eight to twenty milliseconds. During the closing stroke, the traveling contact 64 pushes the retracting contact 62 from the extended position to the retracted position. Then, during the opening stroke, the spring 68 urges the retracting contact 62 back toward the extended position. To effect the desired contactor opening sequence, however, a timing devices retards the expansion of the retracting contact 62 sufficiently to cause the impedance contactor 60 to open before the main power contactor 50 on the opening stroke. This timing device is typically implemented as a puffer mechanism integral to the retracting contact 62. This puffer mechanism typically includes a pneumatic chamber within the retracting contact 62 vented by a restrictive orifice, which retards expansion of the retracting contact through pneumatic compression. A flow control device may be used to affect the size of the restrictive orifice, and thereby control the timing of the expansion of the retracting contact. These features of the switch are described in greater detail with reference to FIG. 11.

It should also be appreciated that locating the timing device on the retracting contact 62 rather than the traveling contact 64 avoids placing the weight associated with the timing device on the traveling contact, which is accelerated to a desired separation speed by the accelerator 14 (shown on FIG. 1). As a result, this design feature is reflected in a smaller and less expensive accelerator. For a relatively inexpensive capacitor switch in a highly cost sensitive marketplace, this type of cost saving can be a significant advantage.

Figure 5:
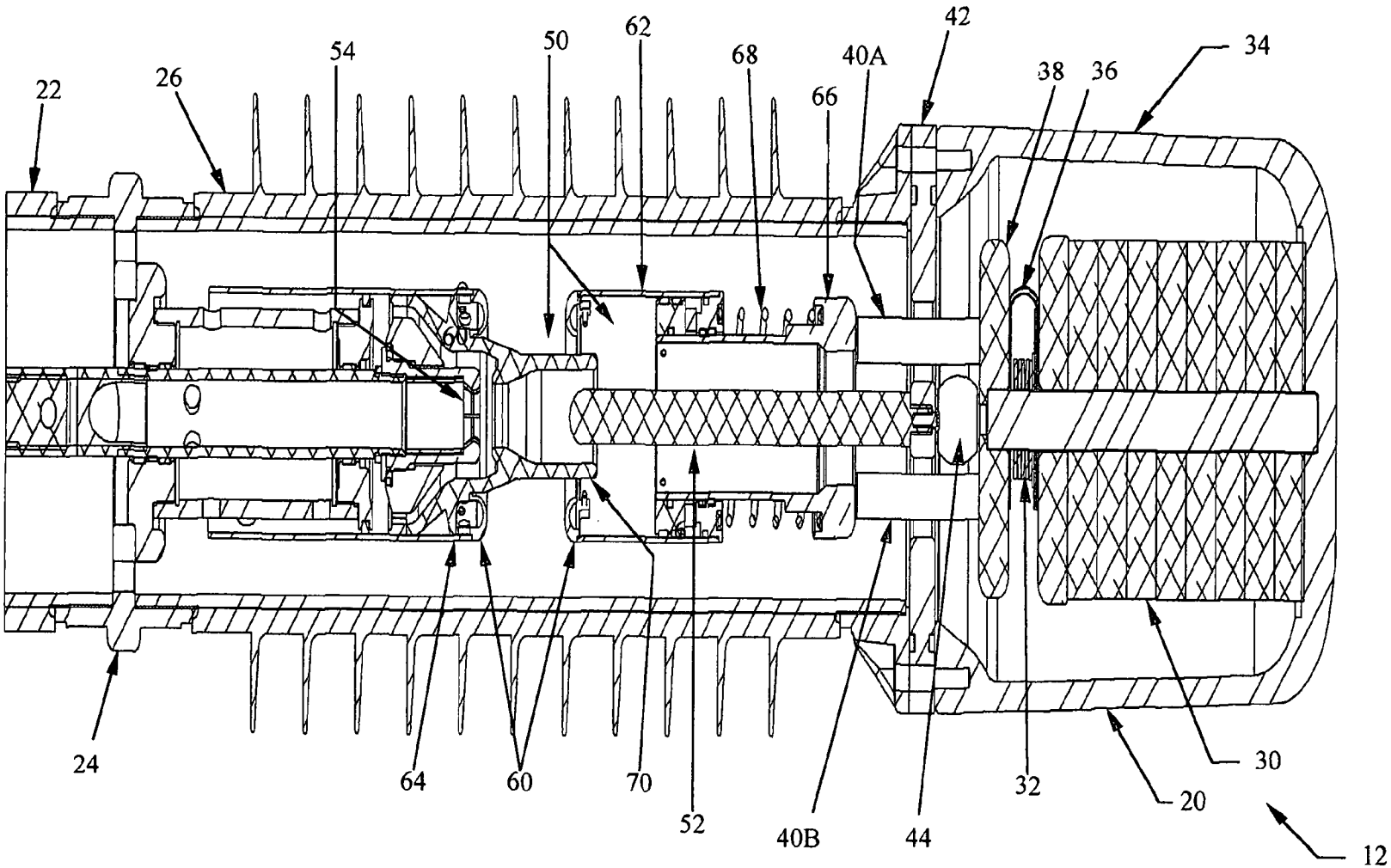
FIG. 5 is a side crosssection view of the capacitor switch in the open position.

FIG. 5 is a side crosssection view of the upper insulator section 26 of the capacitor switch 12 in the open position. Many of the same element numerals introduced with reference to FIGS. 2 through 4 are also shown on FIG. 5. This figure also shows the switch 12 in the fully open position, with the main power contactor 50 as well as the impedance contactor 60 in the open position. In addition, the retracting contact 62 is shown in the fully extended position at it furthest position away from the rear cuff 66 under force applied by the spring 68. The female, tulip-type moving contact 54 of the main power contactor 50 and the ring-type traveling contact 64 of the impedance contactor 60 are also shown in FIG. 5. In addition, the crosssection view of this illustration shows the leaf-type shunt 36, the base plate 38, the spring device 32, and one of the egg-shaped insulators 44 a bit more clearly than they appear in FIG. 4. FIG. 5 also shows the segmented nature of the impedance 30 more clearly than FIG. 4, as well as a nozzle 70 that directs the dielectric gas into the gap of the penetrating contactor 50 on the opening and closing strokes.

Figure 6:
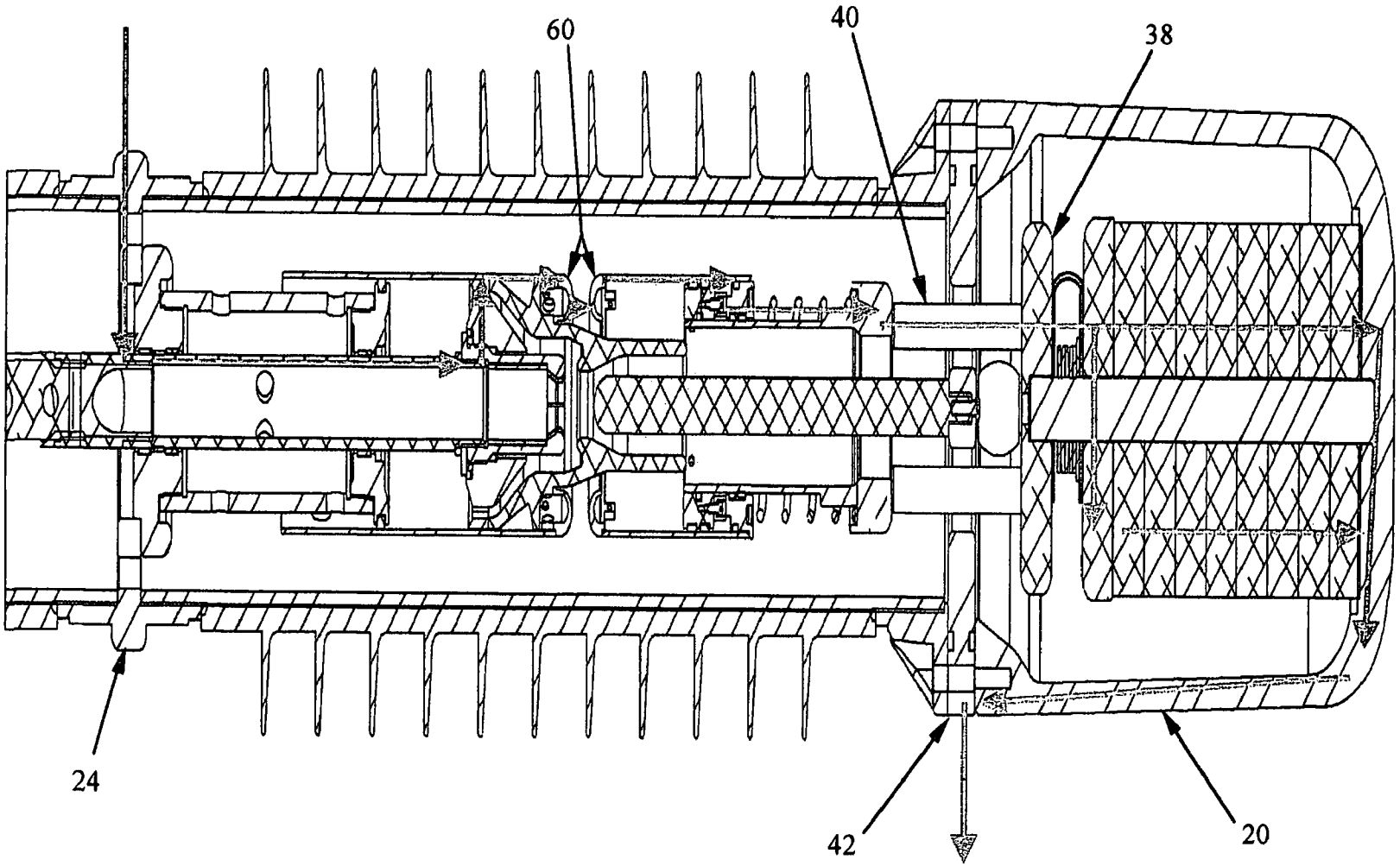
FIG. 6 is a side crosssection view of the capacitor switch with the impedance contactor closed and the power contactor open during the closing stroke.

FIG. 6 is a side crosssection view of the capacitor switch 12 with the impedance contactor 60 closed and the power contactor 50 open during the closing stroke. This figure shows the current path through the switch at this point of the closing stroke, in which the impedance 30 has been introduced into the circuit before the power contactor 50 has closed. That is, the current travels from the line terminal 24 through the impedance contactor 60, through the posts 40, through the leaf-type shunt 36, through the impedance 30, through the conductive end cap 20, through the bottom end plate 42, and on to the capacitor terminal 28 and the attached capacitor. Note that the current does not flow directly from the posts 40 into the bottom end plate 42, but instead flows through the impedance 30 and around the conductive end cap 20 before flowing into the end plate 42 and on to the capacitor terminal 28 and the attached capacitor.

Figure 7:
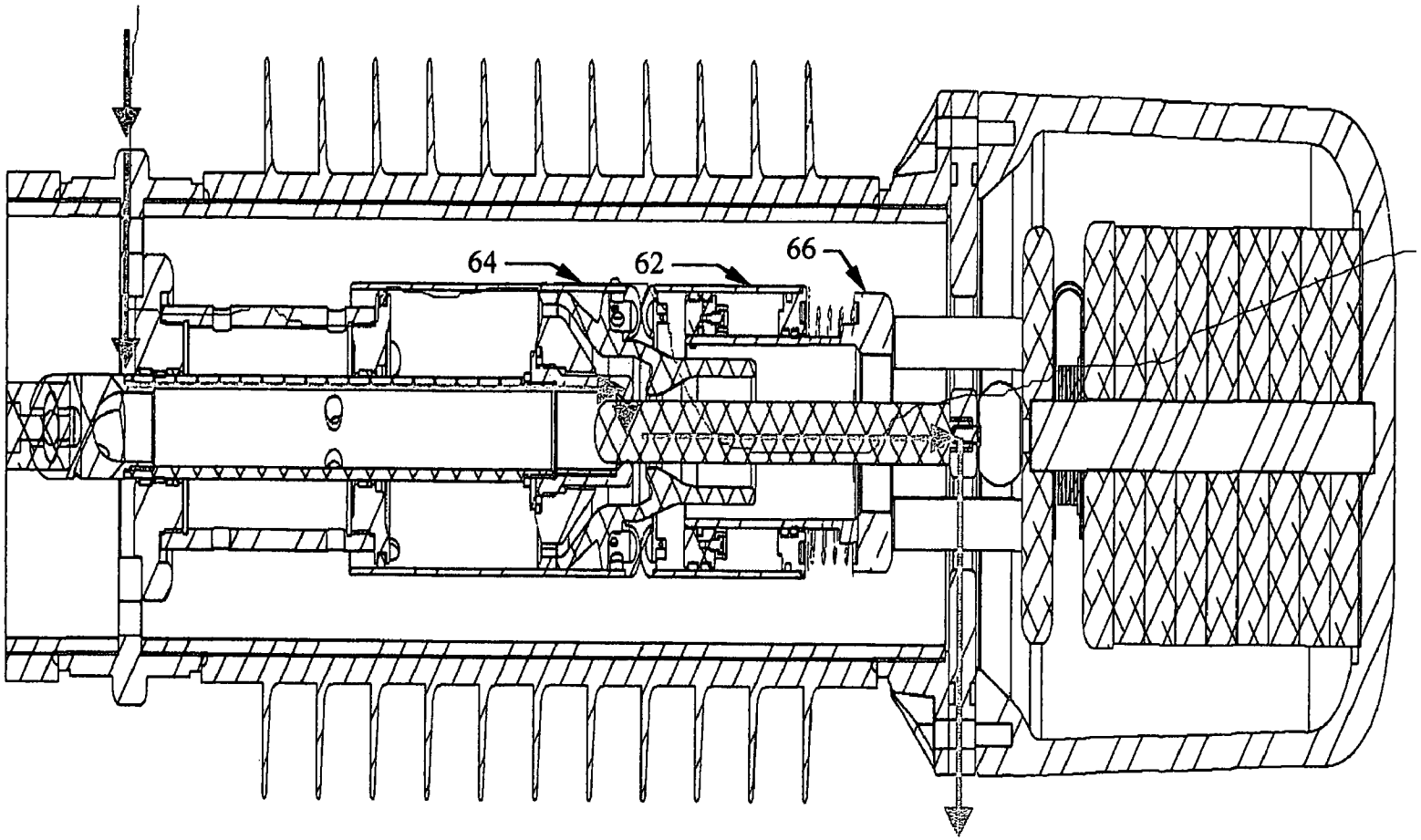
FIG. 7 is a side crosssection view of the capacitor switch with the impedance contactor and the power contactor closed.

FIG. 7 is a side crosssection view of the capacitor switch 12 at the completion of the closing stroke, with the impedance contactor 60 and the power contactor 50 closed. At this point, the current travels from the line terminal 24 through the power contactor 50, through the bottom end plate 42, and on to the capacitor terminal 28 and the attached capacitor. Note that the current path through the impedance 30 is still in the circuit in parallel with the current path through the main power contactor 50, but the current through impedance 30 is negligible due to its much higher impedance. Note also that the traveling contact 64 of the impedance contactor 60 has pushed the retracting contact 62 into its retracted position toward the rear cuff 66.

Figure 8:
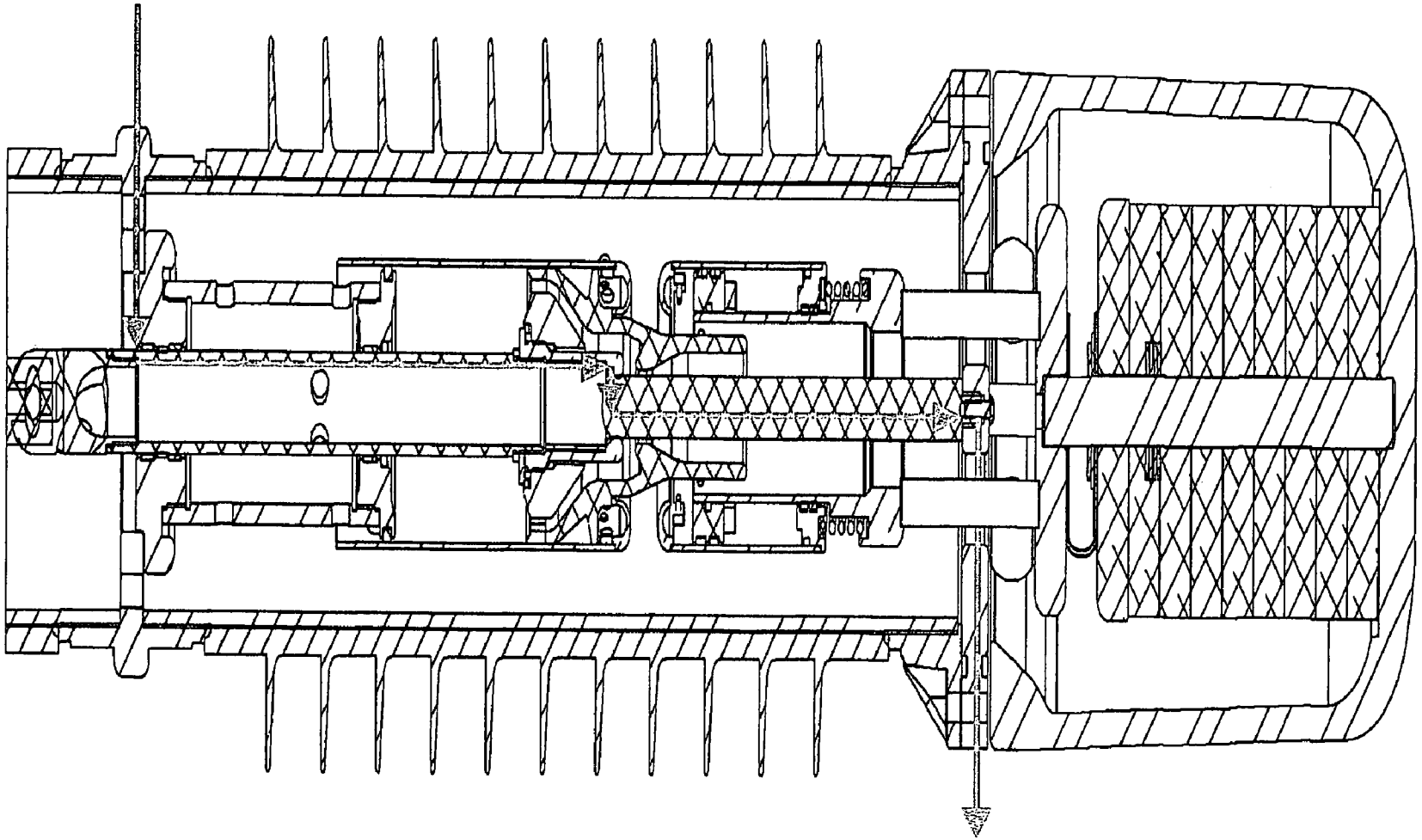
FIG. 8 is a side crosssection view of the capacitor switch with the impedance contactor open and the power contactor closed during the opening stroke.
Figure 9:
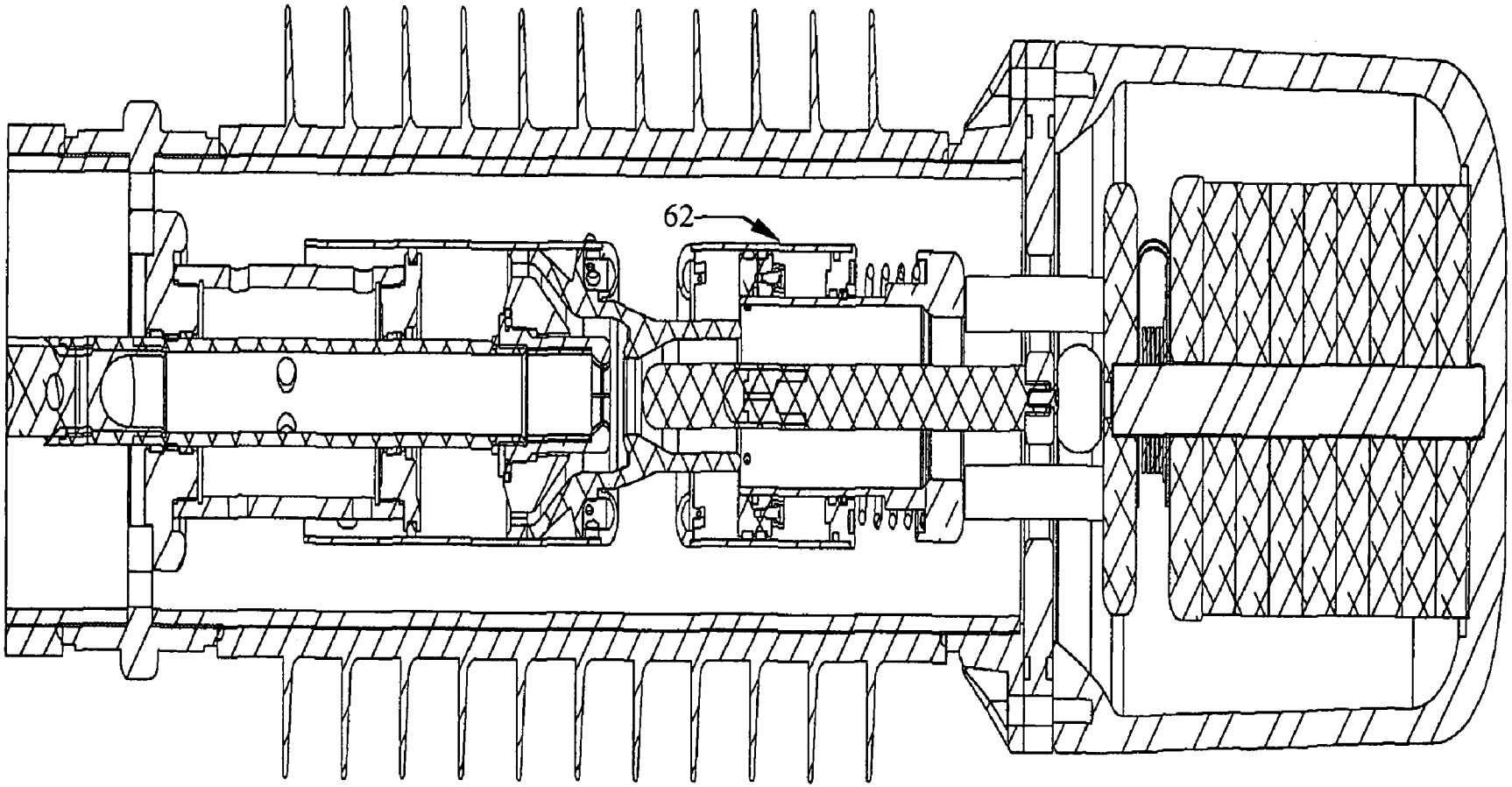
FIG. 9 is a side crosssection view of the capacitor switch with the contactors open and the retracting contact returning to the extended position.
Figure 10:
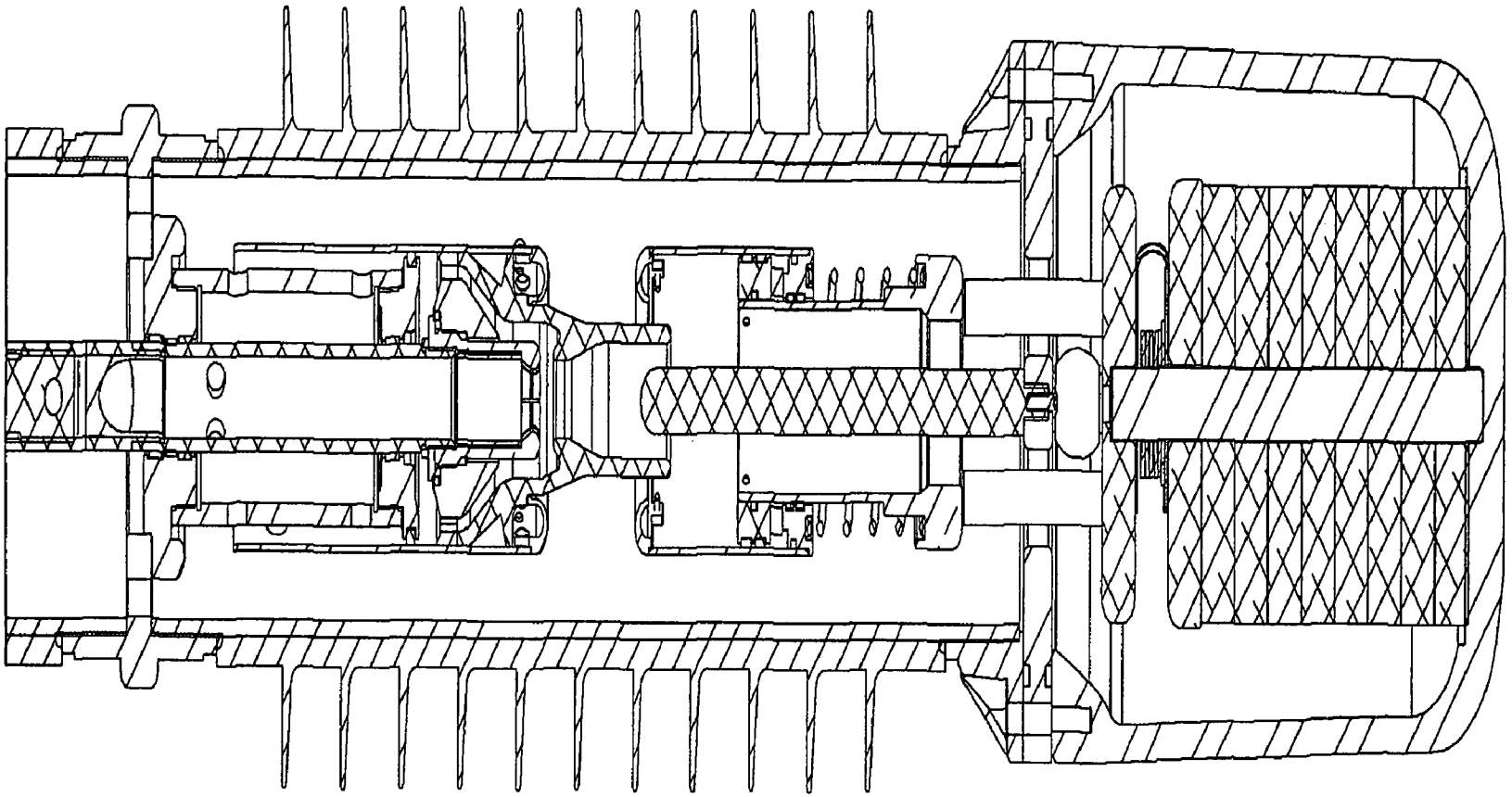
FIG. 10 is a side crosssection view of the capacitor switch returned to the open position with the retracting contact returned to the extended position.

FIG. 8 is a side crosssection view of the capacitor switch 12 during an initial portion of the opening stroke, with the impedance contactor 60 open and the power contactor 60 closed. At this point during the opening stroke, the timing mechanism has retarded the extension of the retracting contact 62 sufficiently to cause the impedance contactor 60 to open while the power contactor 60 is still closed. FIG. 8 shows the switch 12 further into the opening stroke, which the power contactor 60 has also opened. Note that the retracting contact 62 is still partially retracted and the moving contactor 64 has not yet traveled to its fully open position. FIG. 10 shows the switch 12 returned to the fully open position with the retracting contact 62 returned to the extended position.

Figure 11:
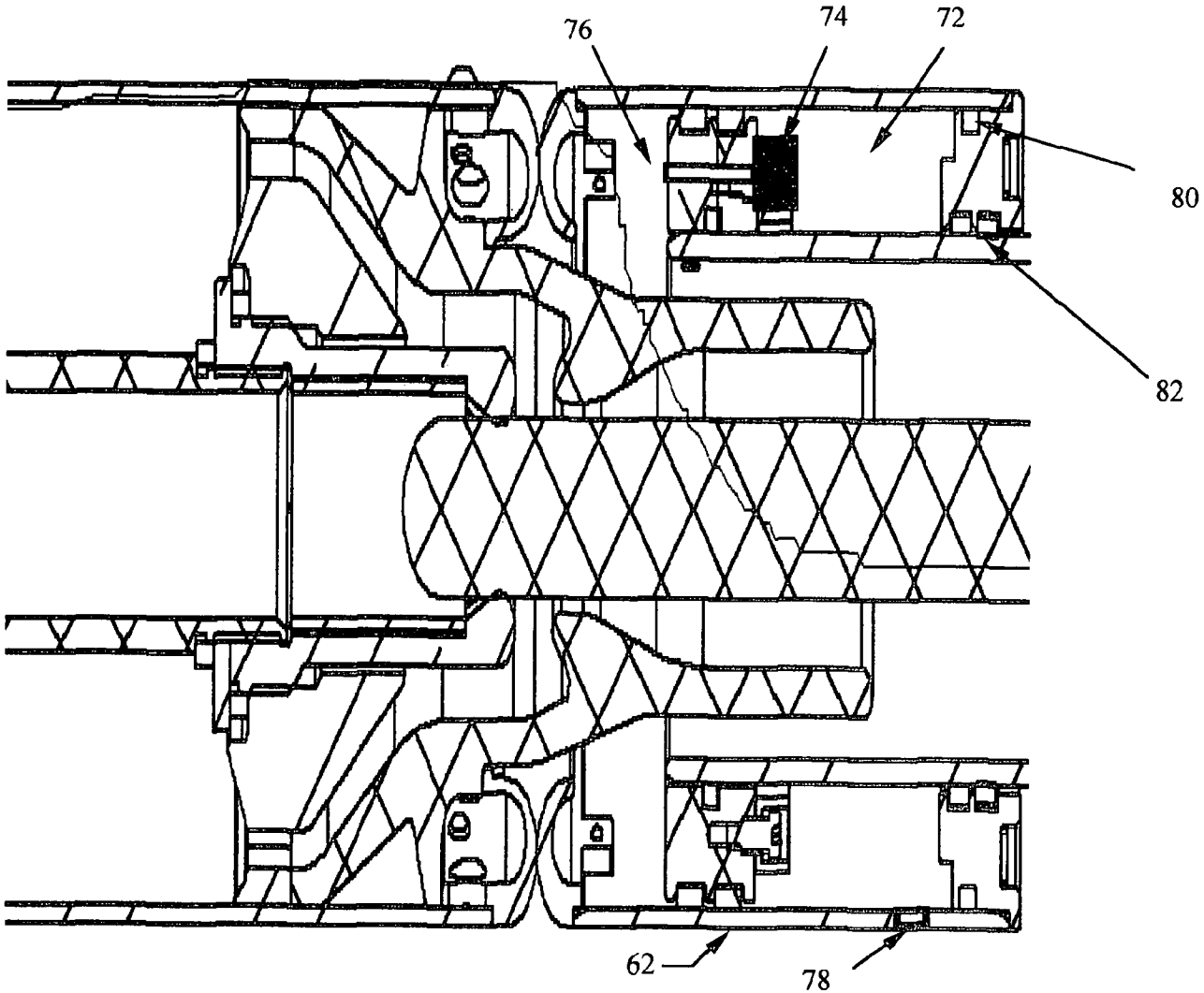
FIG. 11 is a side crosssection view of retracting contact within the capacitor switch showing the puffer mechanism and its flow control device.

FIG. 11 is a side crosssection view of the retracting contact 62 within the capacitor switch showing the puffer mechanism and its flow control device. Specifically, the puffer mechanism includes a pneumatic chamber 72 that is vented by way of a check valve 74 and a port 76 that allows compressible gas to enter by not exit the pneumatic chamber. Exiting compressible gas must pass through a restrictive orifice 78, which functions as a pneumatic damper to control that rate at which the retracting contact 62 expands from its retracted position to its extended position. A flow control device, such as restrictor plate or set screw over the restrictive orifice 78, controls the size of the restrictive orifice and thereby controls the rate at which the retracting contact 62 expands from its retracted position to its extended position. The retracting contact 62 also includes seal 80 and guide rings 82 that seal the rear of the pneumatic chamber 72 while allowing the chamber to increase and decrease in size in response to movement of the retracting contact.

Figure 12:
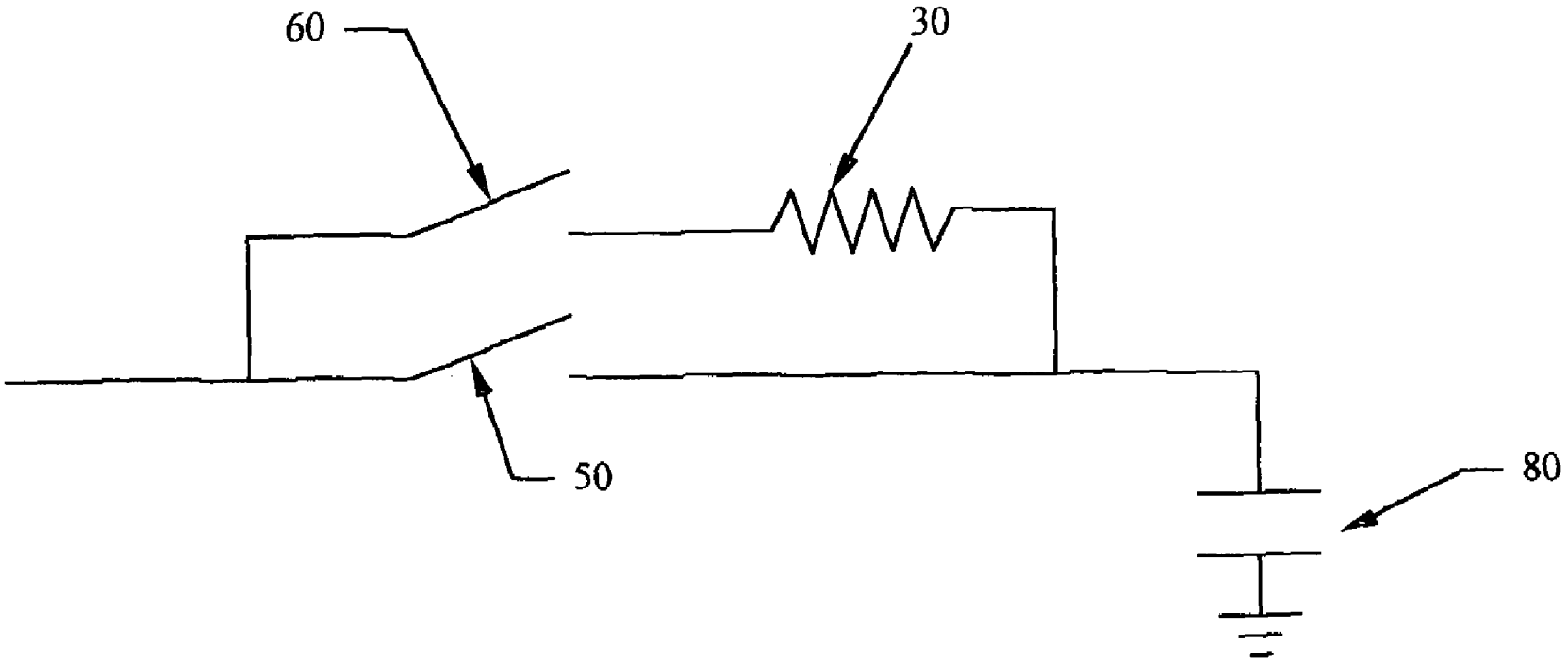
FIG. 12 is an electrical schematic diagram of the capacitor switch.

FIG. 12 is an electrical schematic diagram of the capacitor switch 12 showing the main power contactor 50 connected in parallel with the impedance contactor 60 and the charging impedance 30. This main power contactor 50 and the charging impedance 30, in turn, are both electrically connected to the capacitor 80 (actually a large capacitor bank). For a 72.5 kV sub-transmission voltage application, the charging impedance 30 may be a resistor with a value in the range of 17 Ω to 80 Ω, which is inserted into the electric power circuit for eight to twenty milliseconds for current transient suppression.

Figure 13:
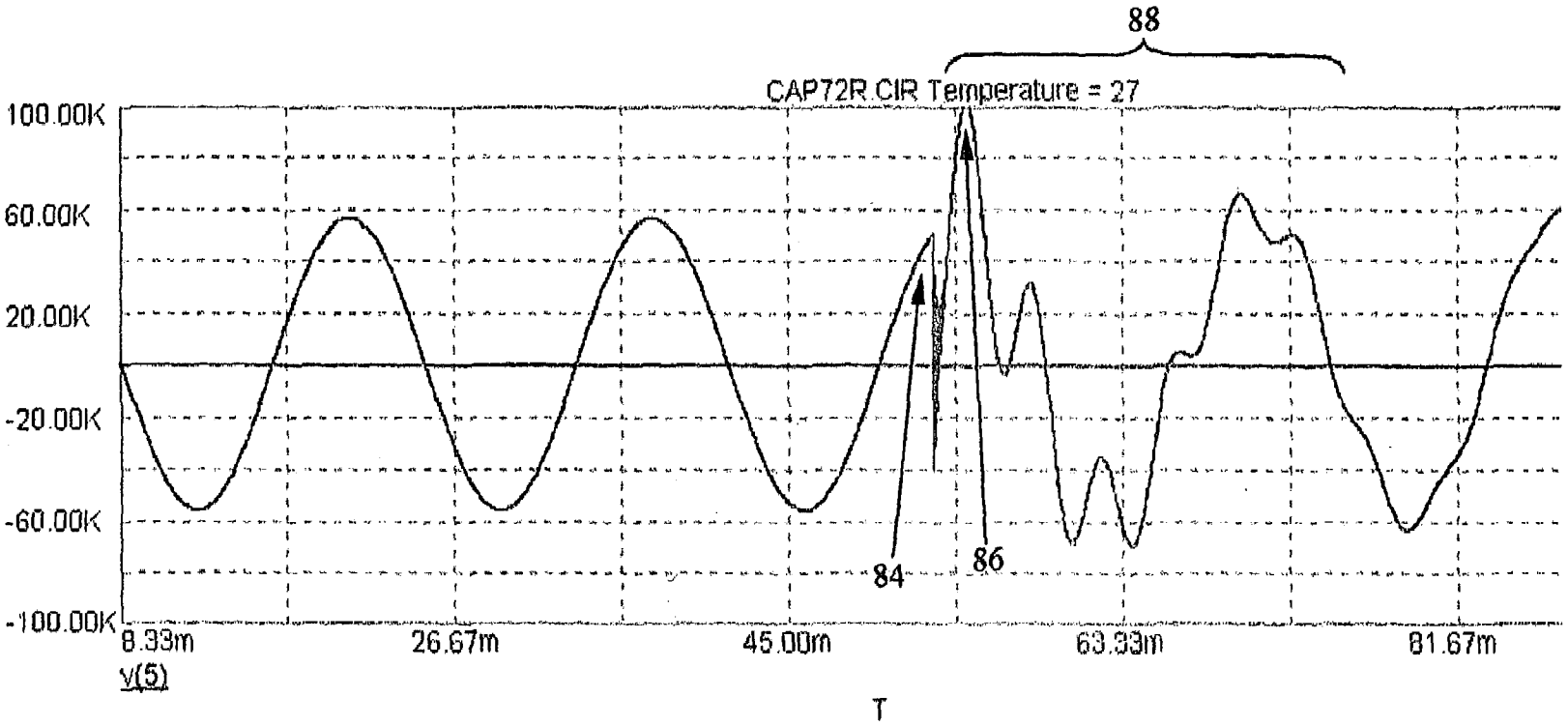
FIG. 13 is a prior art graph illustrating a voltage surge resulting from the operation of a capacitor switch without a charging impedance.
Figure 14:
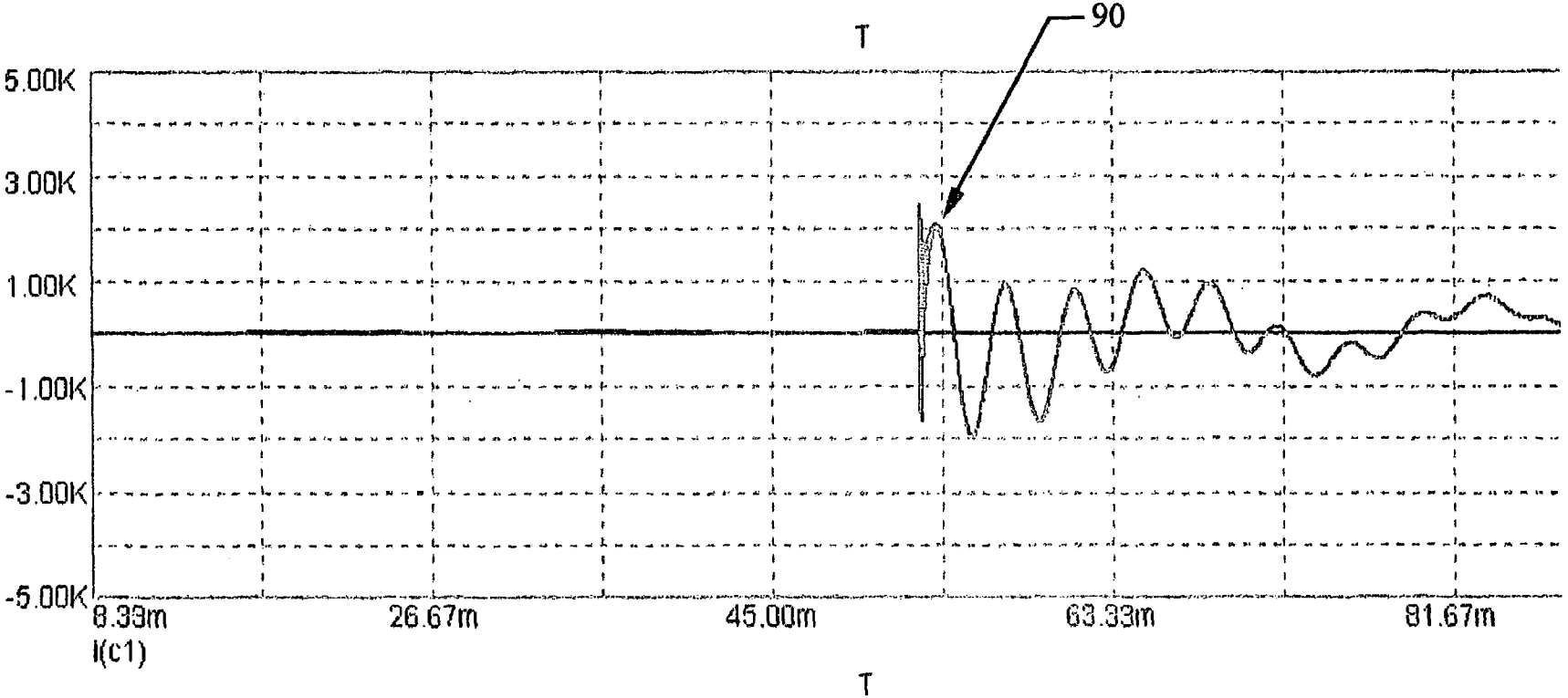
FIG. 14 is a prior art graph illustrating a current transient associated with the voltage surge shown in FIG. 13.

FIG. 13 is a prior art graph illustrating a voltage surge resulting from the operation of a capacitor switch on a 72.5 kV sub-transmission circuit without a charging impedance. The capacitor switch is activated at time point 84, and a voltage surge of approximately 100 kV (i.e., approximately 1.7 per-unit) occurs a short time later at time point 86. In addition, the next two cycles 88 following the operation of the capacitor switch are characterized by significant distortion and over-voltage peaks. FIG. 14 is a graph illustrating the current transient 90 associated with the voltage surge shown in FIG. 13. Note that the current transient spikes to about 3,000 A, which is approximately five times the rated current of 600 A for the circuit.

Figure 15:
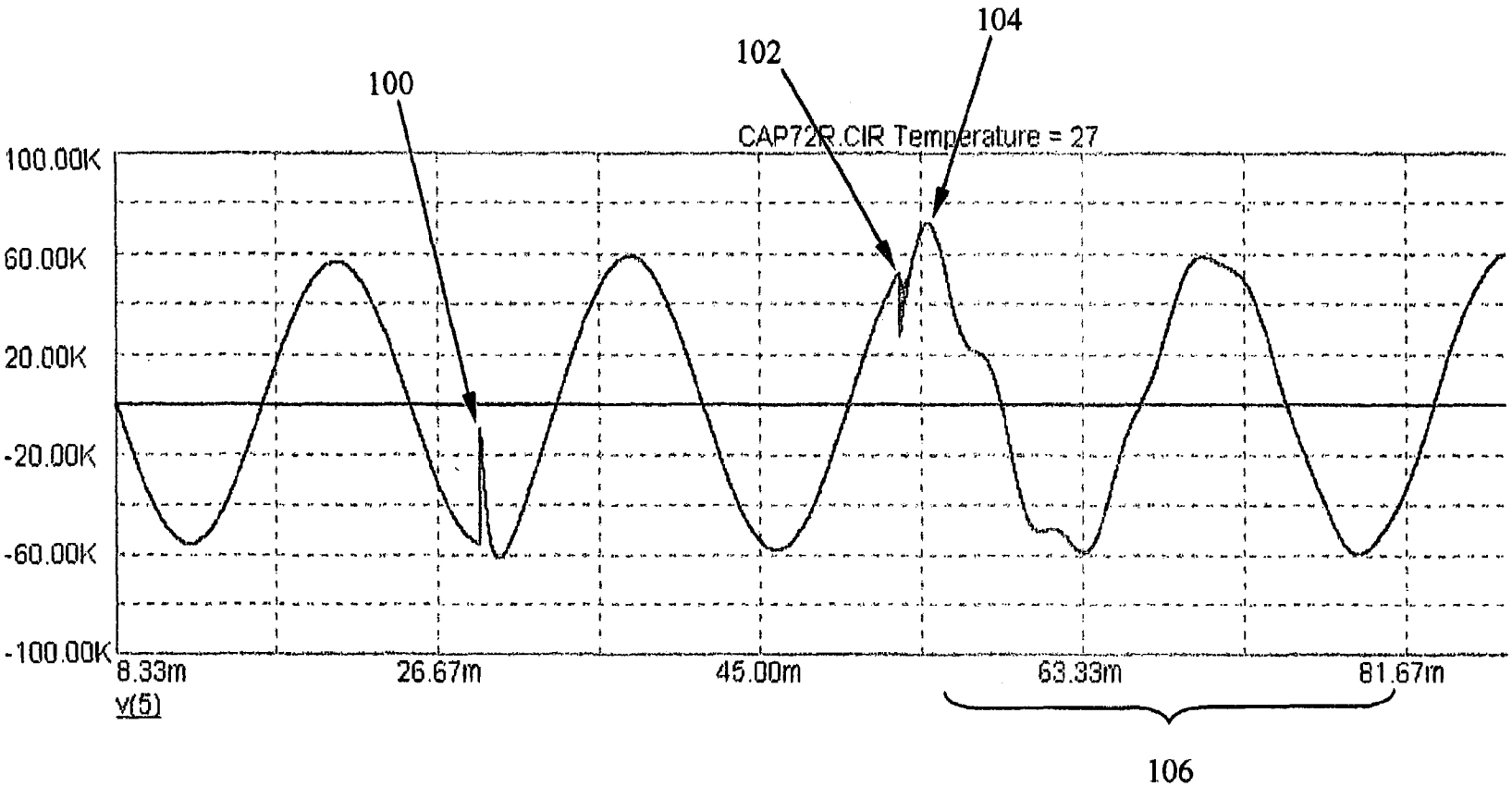
FIG. 15 is a graph illustrating a much smaller voltage surge resulting from the operation of a capacitor switch with a charging resistor.
Figure 16:
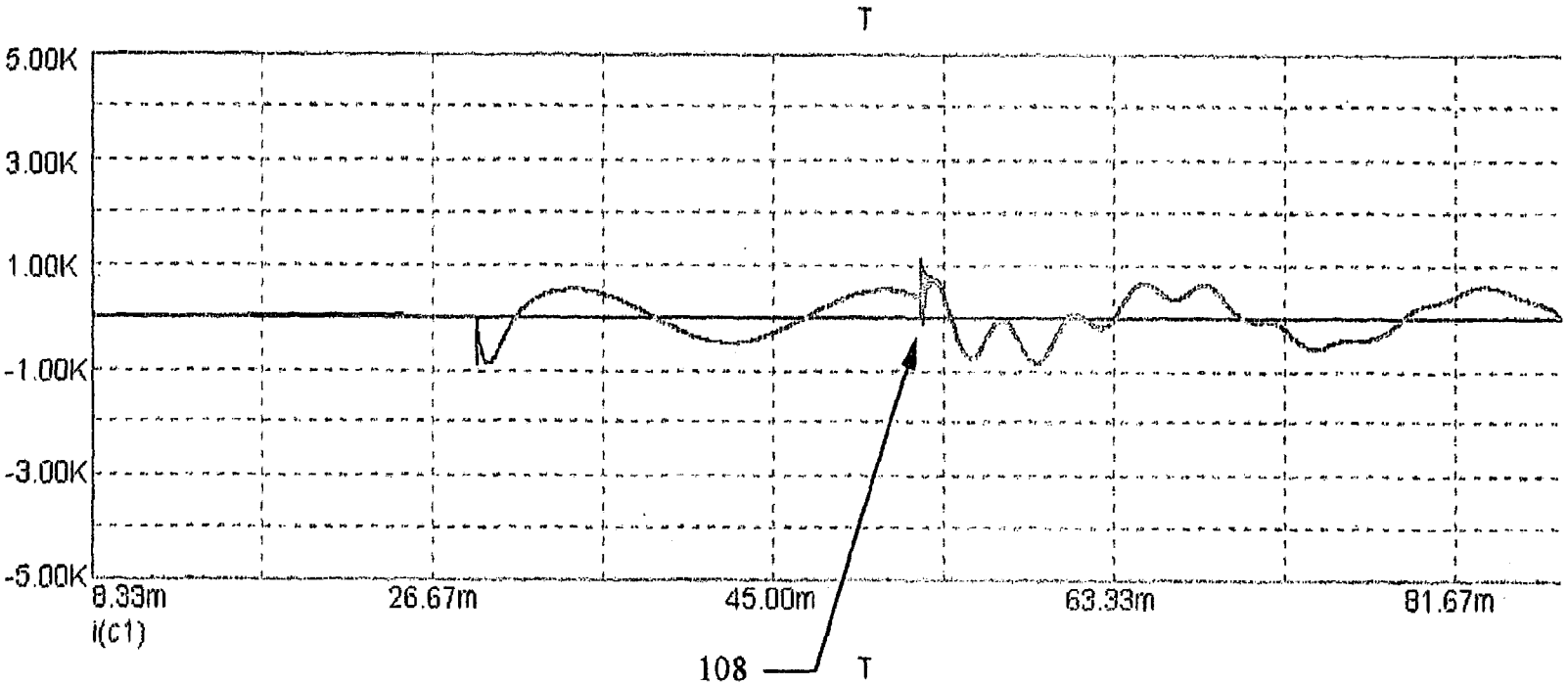
FIG. 16 is a graph illustrating a current transient associated with the voltage surge shown in FIG. 15.

FIG. 15 is a graph illustrating a much smaller voltage surge resulting from the operation of a capacitor switch with a charging resistor. The impedance contactor introduces the charging resistor into the circuit at time point 100, and the main power contactor closes at time point 102. As shown in FIG. 15, a much smaller voltage surge of approximately 72 kV (i.e., approximately 1.2 per-unit) occurs a short time later at time point 104. In addition, the distortion during the next two cycles 106 has been significantly reduced. FIG. 16 is a graph illustrating the current transient 108 associated with the voltage surge shown in FIG. 15, which is much smaller than the current transient 90 shown in FIG. 14 when a charging impedance was not used.

Figure 17:
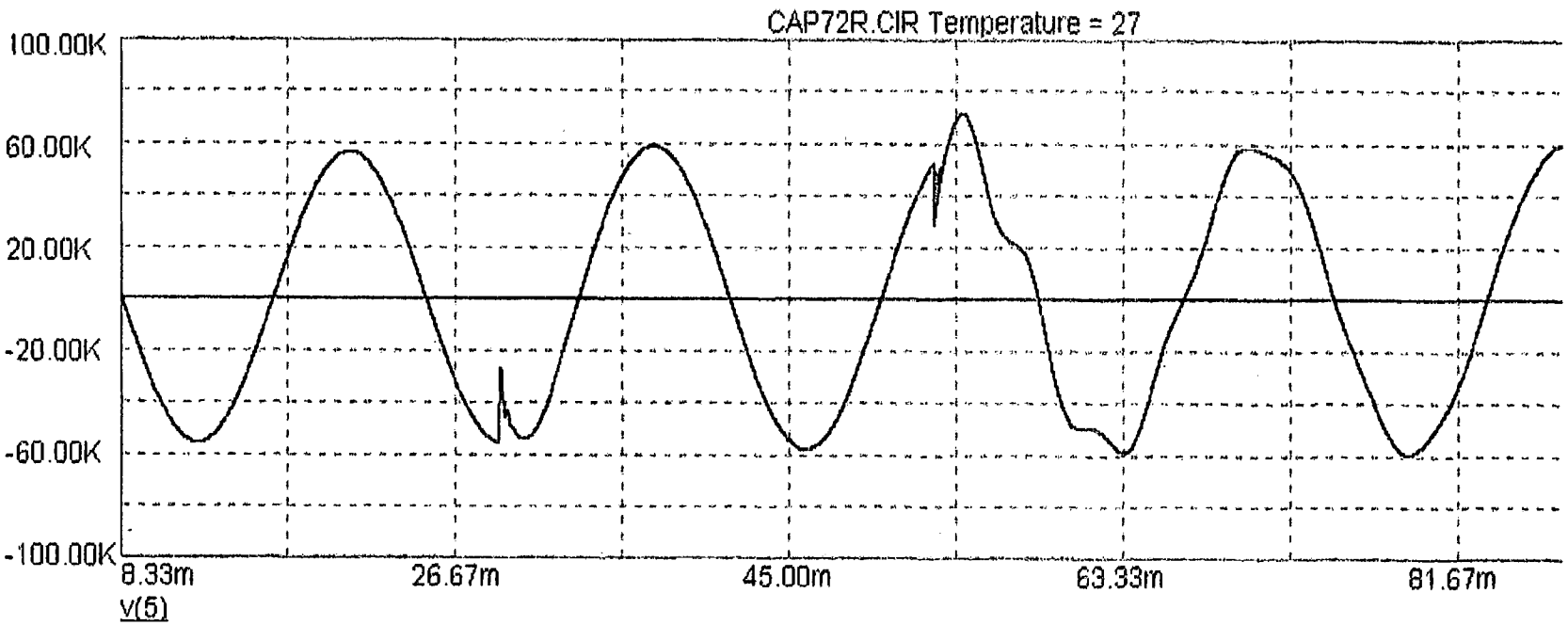
FIG. 17 is a graph illustrating a similar small voltage surge resulting from the operation of a capacitor switch with a charging inductor.
Figure 18:
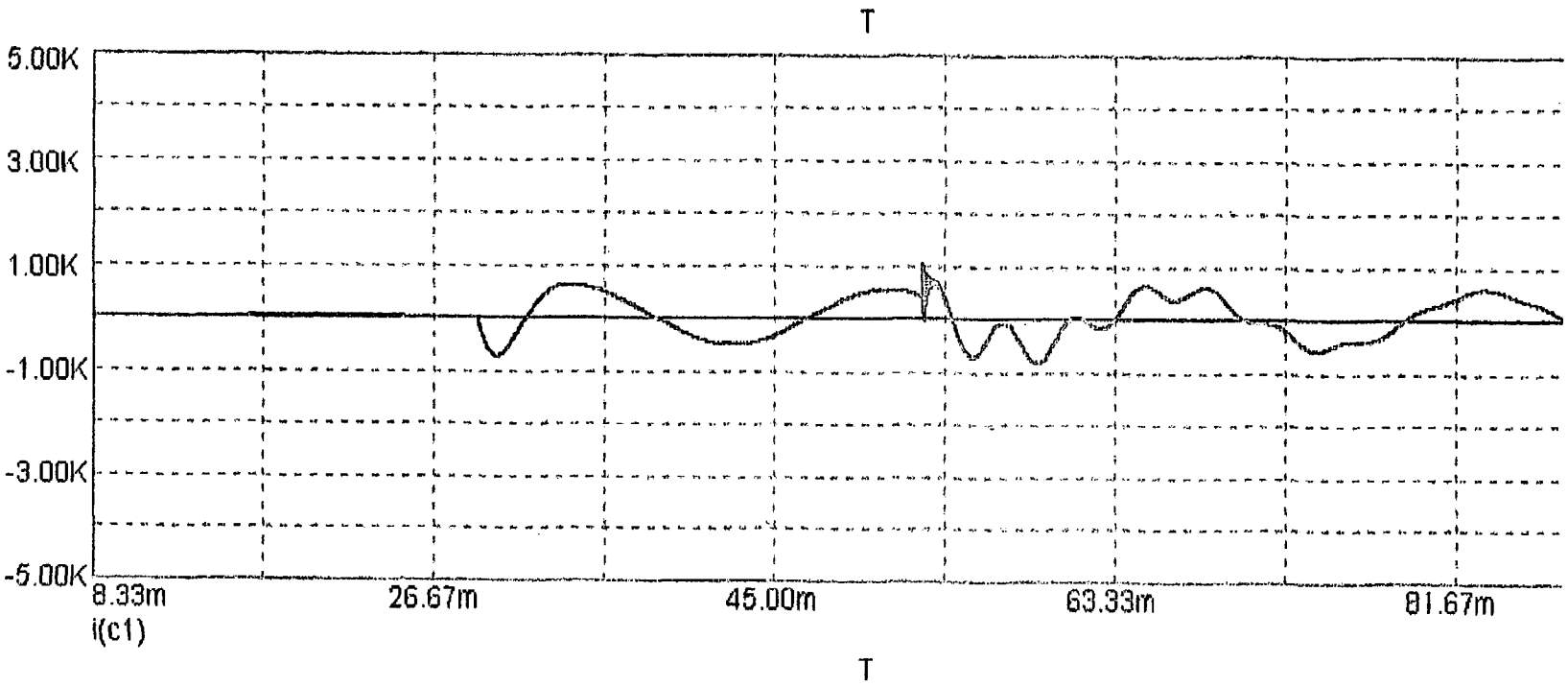
FIG. 18 is a graph illustrating a current transient associated with the voltage surge shown in FIG. 17 illustrating that the capacitor switch exhibits similar transient current suppression when used with a resistor or inductor as the charging impedance.

FIG. 17 is a graph illustrating a similar small voltage surge resulting from the operation of a capacitor switch with a charging inductor, and FIG. 18 is a graph illustrating a current transient associated with the voltage surge shown in FIG. 17. These figures demonstrate that the capacitor switch exhibits similar transient current and voltage surge suppression when used with a resistor or an inductor as the charging impedance.

The present capacitor switch may be implemented as a standard unit that can be employed at multiple standard system voltages, such as 15.5 kV, 25.8 kV, 38 kV, 48.3 kV and 72.5 kV. Obviously, this standard switch is physically configured for the maximum rated system voltage, 72.5 kV. This standard capacitor switch, which is show to scale in FIG. 3, has a height of approximately 67 inches and a diameter of approximately 9⅞ inches. Each insulator is approximately 23 inches long, and the conductive end cap is approximately 18 inches long. Top and bottom flanges account for the additional three inches of overall length of the capacitor switch. The standard switch has a continuous current rating of 600 A and a short circuit current rating of 16 kA. The device is rated to withstand 40 kA RMS and 104 kA peak-to-peak for one second. The charging impedance may be easily changed, and standard resistors of 17 Ω, 40 Ω and 80 Ω are typically available.

These resistors are typically available in "puck" form made from a blend of carbon and ceramic materials. They typically are about one inch thick and have a one inch hole in the center. The outside diameter ranges from two to six inches. For this particular application, the end cap is configured to hold up to eight 5 Ω resistor pucks, for a total of 80 Ω. The capacitor bank connected by the switch may vary, an typically includes from 5 to 75 300 MVAR discrete capacitors connection in a lattice structure. The main power contactor of the switch is typically accelerated to a speed in the range of 2.5 to 5 meters per second over an opening stroke of 100 to 200 millimeters. For example, the standard capacitor switch described above may reach a contactor separation speed of 3.5 m/sec during an opening stroke of 110 mm. The dielectric gas container of the standard capacitor switch typically holds approximately ten pounds of $SF_6$ gas.

Of course, the preceding represent the specific dimensions and ratings one particular illustrative device. These dimensions and rating may all be altered as a matter of design choice to configure the capacitor switch for any desired application.

Figure 19:
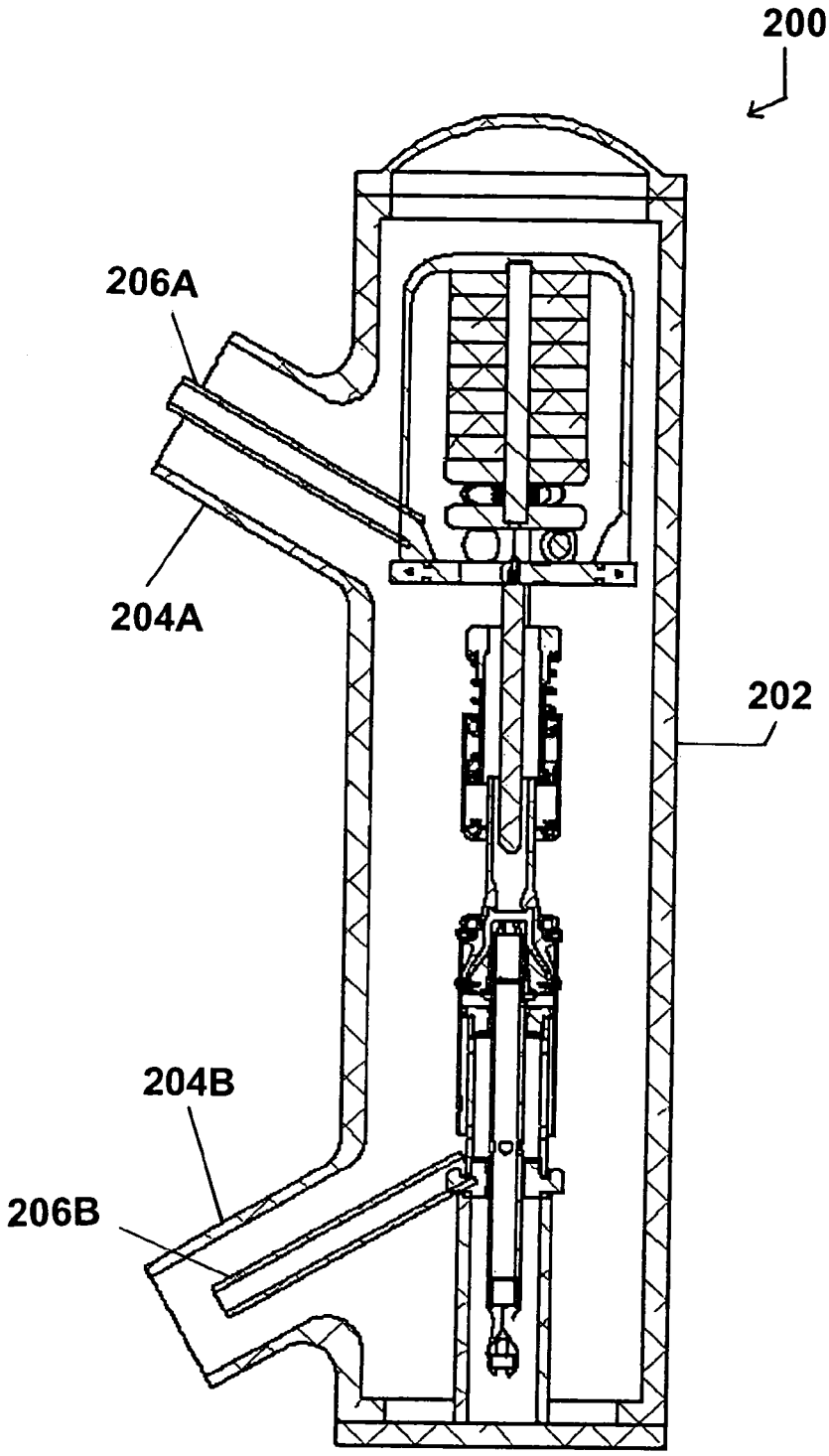
FIG. 19 is a cross section side view of an alternative "dead tank" configuration of the capacitor switch.

FIG. 19 is a cross section side view of an alternative "dead tank" configuration of the capacitor switch 200. This configuration is similar to the capacitor switch 10 except that it is housed within a grounded conductive container 202 in what is typically referred to as a "dead tank" configuration. The dead tank 202 includes high voltage ports 204A–B for bring high voltage leads 206A–B, respectively, into the tank. These ports may be hollow and filled with the $SF_6$ gas typically ad an insulator, or they may include insulating bushings between the ports 204A–B and the leads 206A–B, respectively. The inner working of the capacitor switch 200 are substantially the same as the capacitor switch 10 described previously with reverence to FIGS. 1–18.

In view of the foregoing, it will be appreciated that present invention provides significant improvements in capacitor switches for electric power distribution and sub-transmission applications. It should be understood that the foregoing relates only to the exemplary embodiments of the present invention, and that numerous changes may be made therein without departing from the spirit and scope of the invention as defined by the following claims.

The invention claimed is:

1. An electric power switch, comprising:

an impedance;

a power contactor comprising a fixed contact and a moving contact operable for closing an electric power circuit on a closing stroke and opening the electric circuit on an opening stroke;

an impedance contactor operable for entering the impedance into the circuit on the closing stroke and removing the impedance from the circuit on the opening stroke;

the impedance contactor comprising an annular retracting contact surrounding the fixed contact of the power contactor and an annular traveling contact surrounding and moving with the moving contact of the power contractor; and a timing device comprising a pneumatic chamber within the retracting contact vented by a restrictive orifice operable for causing the impedance contactor to close before the power contactor on the closing stroke, and to cause the impedance contactor to open before the power contactor on the opening stroke.

2. The electric power switch of claim 1, wherein the container comprises an insulator extending between first and second ends a sufficient distance to prevent arcing from occurring between a first electric power terminal located at the first end and a second electric power terminal located at the second end when a rated voltage for the switch is applied across the power terminals.

3. The electric power switch of claim 1, wherein the container comprises a grounded conductive tank.

4. The electric power switch of claim 2, wherein the impedance is enclosed within a conductive cap comprising the first electric power terminal located at the first end of the insulator.

5. The electric power switch of claim 2, wherein the impedance is electrically connected to the contactors within the insulator.

6. The electric power switch of claim 5, further comprising a capacitor introduced into the electric power circuit during the closing stroke and disconnected from the electric power circuit during the opening stroke.

7. The electric power switch of claim 6, further comprising an accelerator driving the power contactor and the impedance contactor at sufficient speed to avoid a restrike during the opening stroke when the capacitor is removed from the electric circuit.

8. The electric power switch of claim 1, wherein:

the retracting contact of the impedance contactor comprises a conductive ring positioned around the fixed contact of the power contactor; and the traveling contact of the impedance contactor comprises a conductive ring positioned around the moving contact of the power contactor.

9. The electric power switch of claim 1, further comprising a container filled with dielectric gas housing the power contactor and the impedance contactor.

10. The electric power switch of claim 1, wherein the timing device resists movement of the retracting contact between the retracted position and the extended position through pneumatic compression on the opening stroke.

11. The electric power switch of claim 4, wherein a first end of the impedance is in electrical contact with a first end of the cap, further comprising:

a base plate located within the cap supporting a second end of the impedance;

at least one insulating spacer located between the base plate and a second end of the cap;

at least one post extending from the base plate and through a hole in the second end of the cap, the post supporting the retracting contact adjacent to the second end of the cap;

wherein the post carries an electric current between the retracting contact and the impedance during operation of the switch.

12. The electric power switch of claim 1, further comprising a flow control device affecting the size of the restrictive orifice and thereby adjusting the timing of the movement of the retracting contactor during the opening stroke.

13. The electric power switch of claim 9, further comprising a nozzle configured to direct a stream of the dielectric gas into a contactor gap occurring across the power contactor during the closing stroke and during the opening stroke.

14. An electric power switch, comprising:

an impedance;

a power contactor including a fixed contact and a moving contact operable for closing an electric power circuit on a closing stroke and opening the circuit on an opening stroke;

an impedance contactor operable for entering the impedance into the circuit on the closing stroke and removing the impedance from the circuit on the opening stroke;

the impedance contactor including an annular retracting contact surrounding the fixed contact of the power contactor and an annular traveling contact surrounding and moving with the moving contact of the power contactor;

the retracting contact movable between an extended position and a retracted position, and configured to retract from the extended position to the retracted position under force applied by the traveling contact during the closing stroke;

a container filled with dielectric gas housing the power contactor;

a nozzle configured to direct a stream of the dielectric gas into a contactor gap occurring across the fixed Contact and the moving contact of the power contactor during the closing stroke and during the opening stroke;

an accelerator driving the power contactor and the impedance contactor at sufficient speed to avoid a restrike during the opening stroke; and a timing device comprising a oneumatic chamber within the retracting contact vented by a restrictive orifice operable for controlling the movement of the retracting contact to cause the impedance contactor to close before the power contactor on the closing stroke, and to cause the impedance contactor to open before the power contactor on the opening stroke.

15. The electric power switch of claim 14, wherein the power contactor comprises a penetrating contactor and the impedance contactor comprises a butt contactor.

16. The electric power switch of claim 14, wherein the impedance contactor is located inside the dielectric gas container.

17. The electric power switch of claim 16, further comprising a capacitor introduced into the electric power circuit during the closing stroke and disconnected from the electric power circuit during the opening stroke.

18. The electric power switch of claim 17, wherein the container comprises an insulator extending between first and second ends a sufficient distance to prevent arcing from occurring between a first electric power terminal located at the first end and a second electric power terminal located at the second end when a rated voltage for the switch is applied across the power terminals.

19. The electric power switch of claim 17, wherein the container comprises a grounded conductive tank.

20. The electric power switch of claim 18, wherein the impedance is enclosed within a conductive cap comprising the first electric power terminal located at the first end of the insulator.

21. The electric power switch of claim 20, wherein a first end of the impedance is in electrical contact with a first end of the cap, further comprising:

a base plate located within the cap supporting a second end of the impedance;

at least one insulating spacer located between the base plate and a second end of the cap;

at least one post extending from the base plate and through a hole in the second end of the cap, the post supporting the retracting contact adjacent to the second end of the cap;

wherein the post carries an electric current between the retracting contact and the impedance during operation of the switch.

22. The electric power switch of claim 21, wherein:

the traveling contact of the impedance contactor comprises a conductive ring positioned around the moving contact of the power contactor; and the retracting contact of the impedance contactor comprises a conductive ring positioned around the fixed contact of the power contactor.

23. The electric power switch of claim 22, further comprising a spring biasing the retracting contact toward the extended position.

24. The electric power switch of claim 14, wherein the timing device resists movement of the retracting contact between the retracted position and the extended position through pneumatic compression on the opening stroke.

25. The electric power switch of claim 24, further comprising a flow control device affecting the size of the restrictive orifice and thereby adjusting the timing of the movement of the retracting contactor.

26. An electric power switch, comprising:

a container filled with dielectric gas comprising an insulator extending between first and second ends a sufficient distance to prevent arcing from occurring between a first electric power terminal located at the first end and a second electric power terminal located at the second end when a rated voltage for the switch is applied across the power terminals;

an impedance enclosed within a conductive cap comprising the first electric power terminal located at the first end of the insulator wherein a first end of the impedance is in electrical contact with a first end of the cap;

a power contactor comprising a linearly moving penetrating contactor housed within the insulator, having a fixed contact and a moving contact, and operable for closing an electric power circuit on a closing stroke and opening the electric circuit on an opening stroke;

an impedance contactor housed within the insulator and operable for entering the impedance into the circuit on the closing stroke and removing the impedance from the circuit on the opening stroke;

the impedance contactor comprising an annular retracting contact surrounding the fixed contact of the power contactor and an annular traveling contact surrounding and moving with the moving contact of the power contactor;

a base plate located within the cap supporting a second end of the impedance, at least one insulating spacer located between the base plate and a second end of the cap, at least one post extending from the base plate and through a hole in the second end of the cap, the post supporting the retracting contact adjacent to the second end of the cap, and wherein the post carries an electric current between the retracting contact and the impedance during operation of the switch; and a timing device operable for causing the impedance contactor to close before the power contactor on the closing stroke, and to cause the impedance contactor to open before the power contactor on the opening stroke.

27. The electric power switch of claim 26, wherein:

the retracting contact of the impedance contactor comprises a conductive ring positioned around the fixed contact of the power contactor; and the traveling contact of the impedance contactor comprises a conductive ring positioned around the moving contact of the power contactor.

28. The electric power switch of claim 26, wherein the timing device comprises a pneumatic chamber within the retracting contact vented by a restrictive orifice.

29. The electric power switch of claim 28, further comprising a flow control device affecting the size of the restrictive orifice venting the pneumatic chamber and thereby adjusting the timing of the movement of the retracting contactor.

30. The electric power switch of claim 26, further comprising a capacitor introduced into the electric power circuit during the closing stroke and disconnected from the electric power circuit during the opening stroke.

31. The electric power switch of claim 30, further comprising an accelerator driving the power contactor and the impedance contactor at sufficient speed to avoid a restrike during the opening stroke when the capacitor is removed from the electric circuit.

32. The electric power switch of claim 31, further comprising a nozzle configured to direct a stream of the dielectric gas into a contactor gap occurring across the fixed contact and the moving contact of the power contactor during the closing stroke and during the opening stroke.

33. The electric power switch of claim 28, wherein the timing device resists movement of the retracting contact between the retracted position and the extended position through pneumatic compression on the opening stroke.

* * * * *